US005271462A

United States Patent [19]

Berzin

[11] Patent Number: 5,271,462

[45] Date of Patent: Dec. 21, 1993

[54] ZONE ISOLATION APPARATUS

[75] Inventor: Vel Berzin, Houston, Tex.

[73] Assignee: Baker Hughes Incorporated, Houston, Tex.

[21] Appl. No.: 3,776

[22] Filed: Jan. 13, 1993

[51] Int. Cl.[5] ..... E21B 23/00

[52] U.S. Cl. ..... 166/191; 166/122

[58] Field of Search ..... 166/179, 184, 191, 120, 166/122, 126, 128, 131, 385-387

[56] References Cited

U.S. PATENT DOCUMENTS 4,962,815 10/1990 Schultz et al. ..... 166/191 X
5,058,673 10/1991 Muller et al. ..... 166/191 X
5,152,340 10/1992 Clark et al. ..... 166/191 X

*Primary Examiner*—Thuy M. Bui
*Attorney, Agent, or Firm*—Melvin A. Hunn

[57] ABSTRACT

A zone isolation apparatus is provided which allows for selective communication of fluid between a workstring and one or more subterranean zones. Fluid-pressure actuated packers may be placed in any desired location within a workstring without regard to the placement of the other packers, allowing maximum user flexibility and on-site configuration of the zone isolation apparatus. Each packer includes a rotary coupling to allow rotation of the workstring during running and sealing modes of operation. A latch mechanism is provided to prevent premature or accidental inflation.

36 Claims, 32 Drawing Sheets

ZONE ISOLATION APPARATUS

BACKGROUND OF THE INVENTION

1. Field of the Invention

The present invention relates to wellbore tools which provide selective fluid communication with subterranean wellbore zones, and which are especially useful in delivering production-enhancing fluids to a particular producing zone.

2. Description of the Prior Art

In the completion and work over of producing oil and gas wells, it is frequently necessary to selectively communicate fluids between a workstring and one particular region of the wellbore, to the exclusion of other regions of the wellbore. Typically, such operations involve the selective delivery of production-enhancing fluids to a target zone. Such fluids may wash debris from the region of the wellbore which is adjacent the target zone, may clear a flow path from a producing zone to a region of a wellbore, or may stimulate production from oil and gas bearing formations by altering the chemical or mechanical properties of either the producing formation itself or the oil and gas deposits contained therein. Such operations include acidizing, washing, and fracturing of the oil and gas producing formations. Of course, it is not efficient to deliver the production-enhancing fluids to all regions of the wellbore when only a particular region needs the treatment. Therefore, washing tools have been developed which isolate a region of a wellbore which is in communication with a selected zone of interest, and which allow for the selective delivery of product-enhancing fluids to that particular zone.

It is also frequently desirable to selectively remove fluids from a particular zone in a producing oil and gas wellbore. The removal of fluid is particularly useful in testing and sampling operations to establish flow rates, water cut, and production volume from a particular zone. Of course, if the fluid from the zone of interest mixes with fluids from other regions of the wellbore, meaningful testing and sampling operations can not be obtained. Prior art tools exists which allow for the selective sampling and testing of fluids from a target zone.

Typically, the prior art devices for communicating fluids between a workstring and a selected wellbore zone include isolator members which are coupled to a housing which is carried exteriorly of a workstring. The isolator members do not move freely with respect to the workstring, and thus may become damaged when the tool is run into a wellbore, particularly when the wellbore is deviated, horizontal, or contains "dog leg" bends. It is a common practice to custom manufacture such tools with the isolator members spread apart a selected distance to accommodate a particular zone length. It is common for these tools to be lengthy and cumbersome to manipulate. They are also quite expensive since substantial amounts of material are required to fabricate the elongated housing to which the isolator members are attached.

SUMMARY OF THE INVENTION

It is one objective of the present invention to provide a zone isolation apparatus for use in subterranean wellbores which includes a workstring, a plurality of fluid-pressure actuated seal members carried about the workstring at selected locations, and rotary couplings between the plurality of fluid pressure actuated seal members and the workstring, which allow relative rotation between said plurality of fluid-pressure actuated seal elements and the workstring during a running mode of operation with the plurality of fluid-pressure actuated seals in radially reduced positions and during a sealing mode of operation with the plurality of fluid-pressure actuated seal elements in radially enlarged positions and in sealing engagement with a selected wellbore surface.

It is another objective of the present invention to provide a zone isolation apparatus which defines a plurality of fluid communication ports which enable selective communication between the workstring, and regions of the subterranean wellbore which are above, below, and between fluid-pressure actuated seal members.

It is yet another objective of the present invention to provide a zone isolation apparatus which includes a means for coupling any selected number of wellbore tubular conduit members into the workstring between fluid-pressure actuated seal members to allow a range of possible spacings between the fluid-pressure actuated seal members.

It is still another objective of the present invention to provide a zone isolation apparatus which is operable in a plurality of modes of operation, and which is switched between selected modes of operation by axial movement of the workstring relative to fluid-pressure actuated seal members.

It is still another objective of the present invention to provide a zone isolation apparatus which is operable in a plurality of modes of operation, which is switchable between selected modes of operation by axial displacement of a workstring relative to fluid-pressure actuated seal members, and which includes a latch for securing the workstring in a fixed axial position relative to the fluid-pressure actuated seal members until said fluid-pressure actuated seal members are fully inflated and engaging a selected wellbore surface.

These objectives are achieved as is now described. The zone isolation apparatus is adapted for use in a subterranean wellbore and includes a number of components which cooperate together. A workstring is provided and a plurality of fluid-pressure actuated seal members are carried about the workstring at selected locations. A rotary coupling is provided between the plurality of fluid-pressure actuated seal members and the workstring, which allow relative rotation of the plurality of fluid-pressure actuated seal members and the workstring during a running mode of operation and a sealing mode of operation. During the running mode of operation, the plurality of fluid-pressure actuated seal members are in radially reduced positions. During the sealing mode of operation, the plurality of fluid-pressure actuated seal members are in radially enlarged positions and in sealing engagement with a selected wellbore surface. Preferably, a means for coupling is provided for coupling any selected number of wellbore tubular conduit members into the workstring between selected ones of the plurality of fluid-pressure actuated seal members to allow a range of possible spacings between the fluid-pressure actuated seal members. Preferably, the means for coupling allows coupling of these wellbore tubular conduit members on location at the subterranean wellbore with the application of torque only.

In the preferred embodiment, the zone isolation apparatus includes an inflation port which, while in an open condition, allows fluids to communicate between the central bore of the workstring to an inflation chamber. The inflation port is switched between open and closed conditions by axial movement of the workstring. Also, in the preferred embodiment, a plurality of fluid communication ports are provided which allow selective communication between the workstring and selected regions of the wellbore above, between, and below a selected pair of fluid-pressure actuated seal members.

These fluid communication ports include a first fluid communication port which, while in an open condition, allows fluids to communicate between the workstring and a region of the subterranean wellbore above the selected pair of fluid-pressure actuated seal members; and which, while in a closed condition, prevents communication between the workstring and the region of the subterranean wellbore above the selected pair of fluid-pressure actuated seal members. A second fluid communication port is provided which, while in an open condition, allows fluid to communicate between the workstring and a region between the selected pair of fluid-pressure actuated seal members; and which, while in a closed condition, prevents communication between the workstring and the region of the subterranean wellbore between the selected pair of fluid-pressure actuated seal members. A third fluid communication port is provided which, while in an open condition, allows fluid to communicate between the workstring and a region below the selected pair of fluid-pressure actuated seal members; and which, while in a closed condition, prevents communication between said workstring and said region of a subterranean wellbore below the selected pair of fluid-pressure actuated seal members.

In the preferred embodiment of the present invention, the fluid-pressure actuated seal members include a flexible seal member in contact with an inflation chamber, and a latch member which prevents axial movement of the workstring relative to the fluid-pressure actuated seal members until a predetermined fluid pressure threshold, sufficient to expand outwardly said flexible seal member into sealing engagement with the selected wellbore surface, is exceeded by fluid carried in the workstring. Preferably, the latch member includes (a) a collet member which releasably engages a mating member to hold together a housing and a mandrel in a fixed relative axial position, (b) a buttress member for selectively engaging a portion of the collet to prevent its flexure, and (c) a release mechanism for maintaining the buttress member in engagement with the collet member until fluid in the workstring exceeds a preselected fluid-pressure threshold.

Additional objectives, features and advantages will be apparent in the written description which follows.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIGS. 4*a* through 4*l* are one-quarter longitudinal section views of the preferred embodiment of an upper isolator member of the zone isolation apparatus of the present invention;

DETAILED DESCRIPTION OF THE INVENTION

Figure 1:
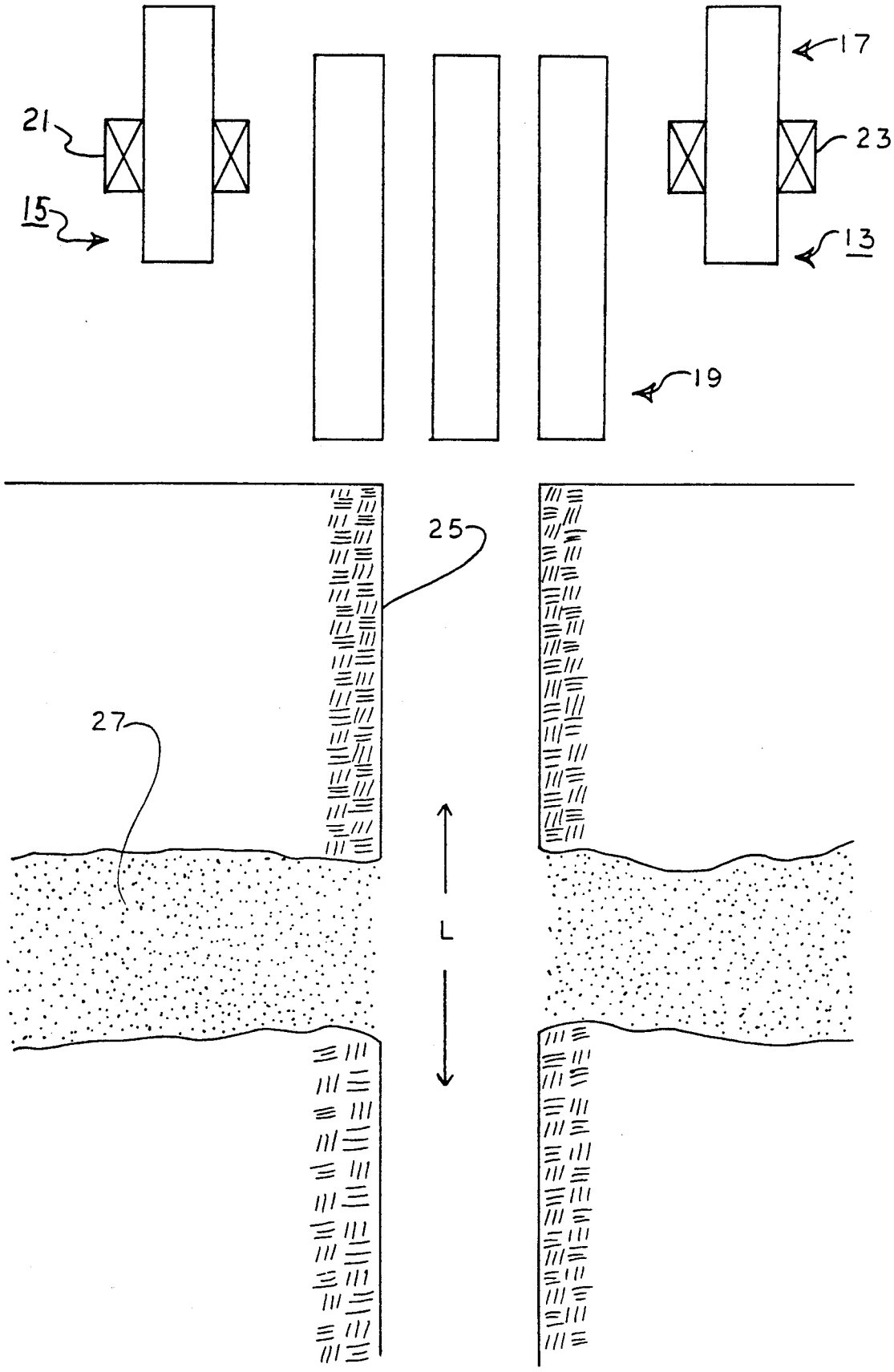
FIG. 1 is a simplified and diagrammatic view of the zone isolation apparatus of the present invention on location at a subterranean wellbore.

FIG. 1 is a simplified and diagrammatic view of the preferred zone isolation apparatus 13 of the present invention on location at subterranean wellbore 25. Preferably, zone isolation apparatus 13 includes upper isolator member 15 and lower isolator member 17. A plurality of wellbore tubular conduit members 19 are provided for coupling above, below, and between upper and lower isolator members 15, 17. In the preferred embodiment, upper and lower isolator members 15, 17 include fluid-pressure actuated seal members 21, 23, respectively. Fluid-pressure actuated seal members 21, 23 are adapted to receive pressure fluid and expand from a radially-reduced running condition to a radially-expanded setting condition. In the setting condition, fluid-pressure actuated seal members 21, 23 operate to engage and seal against subterranean wellbore 25 at a selected surface, such as an uncased or cased wellbore wall.

Preferably, upper and lower isolator members 15, 17, and wellbore tubular conduit members 19 are threaded at their upper and lower ends, with conventional pin and box connectors, to allow assembly of a workstring which includes upper and lower isolator members 15, 17 disposed at selected locations within the string, and with a selected spacing therebetween which is sufficient to allow zone isolation apparatus 13 to straddle target zone 27 (and other zones in communication with target zone 27) within subterranean wellbore 25, with upper isolator member 15 in sealing and gripping engagement with subterranean wellbore above target zone 27, and with lower isolator member 17 in gripping and sealing engagement with subterranean wellbore 25 below target zone 27. In this configuration, selective fluid communication is allowed between the workstring and target zone 27 to the exclusion of other regions of subterranean wellbore 25 including other producing and non-producing zones as well as annular regions within wellbore 25 between the workstring and zone isolation apparatus 13.

The threaded pin and box couplings between upper and lower isolator members 15, 17 and wellbore tubular conduit members 19 allows for the placement of any selected number of wellbore tubular conduit members into the workstring between the fluid-pressure actuated seal members 21, 23 to allow a range of possible spacings between the seal members to accommodate different target zones having different lengths. The preferred embodiment of the present invention allows the spacing between the upper and lower isolator members 15, 17 to be determined on location at the subterranean wellbore, and thus does not require that the zone isolation apparatus be prefabricated to a specific length by the manufacturer. Since conventional pin and box threaded couplings are provided at the upper and lower ends of upper and lower isolator members 15, 17 the workstring can be made up with the application of torque only, and thus the zone isolation apparatus 13 of the present invention can be assembled in the field with conventional torquing equipment.

Figure 2:
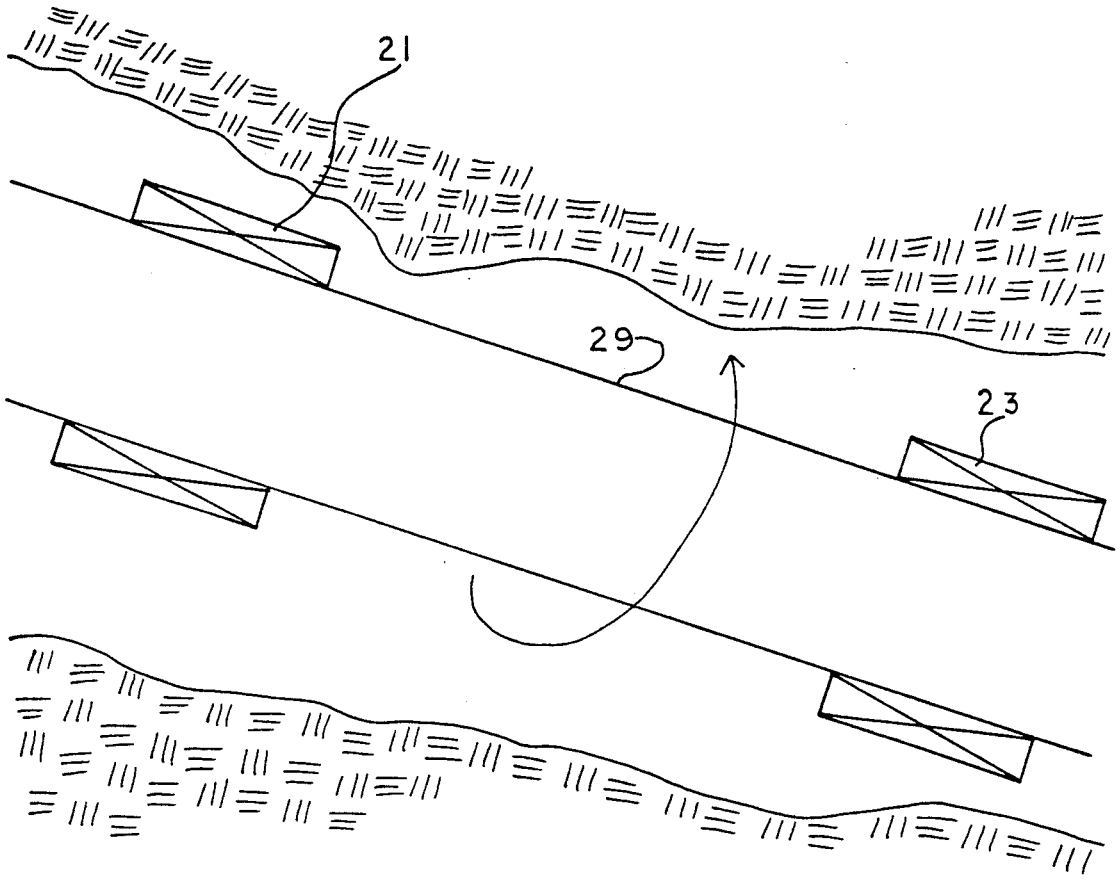
FIG. 2 is a simplified view of the zone isolation apparatus of the present invention disposed in a horizontal wellbore.

FIG. 2 is a simplified view of zone isolation apparatus 13 of the present invention disposed in a horizontal portion of subterranean wellbore 25. Preferably, a rotary coupling is provided between fluid-pressure actuated seal members 21, 23 and workstring 29 to allow relative rotation therebetween. FIG. 2 depicts a situation wherein fluid-pressure actuated seal members 21, 23 are engaging the upper and lower surfaces, respectively, of subterranean wellbore 25. Since it is common to torque and force a workstring into position within a horizontal wellbore, fluid-pressure actuated seal members 21, 23 may engage subterranean wellbore 25 while allowing workstring 29 to be rotated. The rotary coupling between fluid-pressure actuated seal members 21, 23 ensures that they are not likely to become damaged due to rotation of workstring 29. The particular type of rotary coupling between workstring 29 and fluid-pressure actuated seal members 21, 23 will be described in detail herebelow.

Figure 3A:
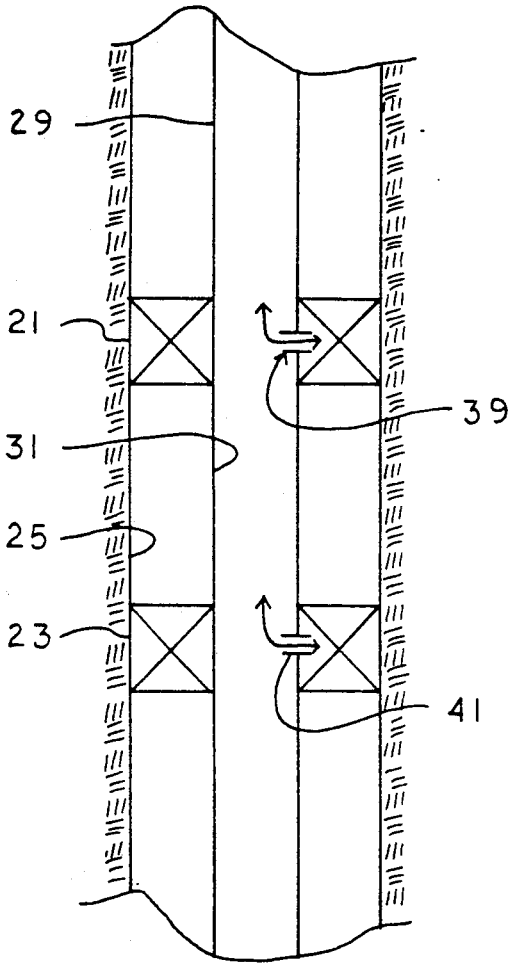
FIGS. 3*a* through 3*f* are simplified and diagrammatic views of the preferred embodiment of the zone isolation tool of the present invention in a plurality of differing modes of operation.
Figure 3B:
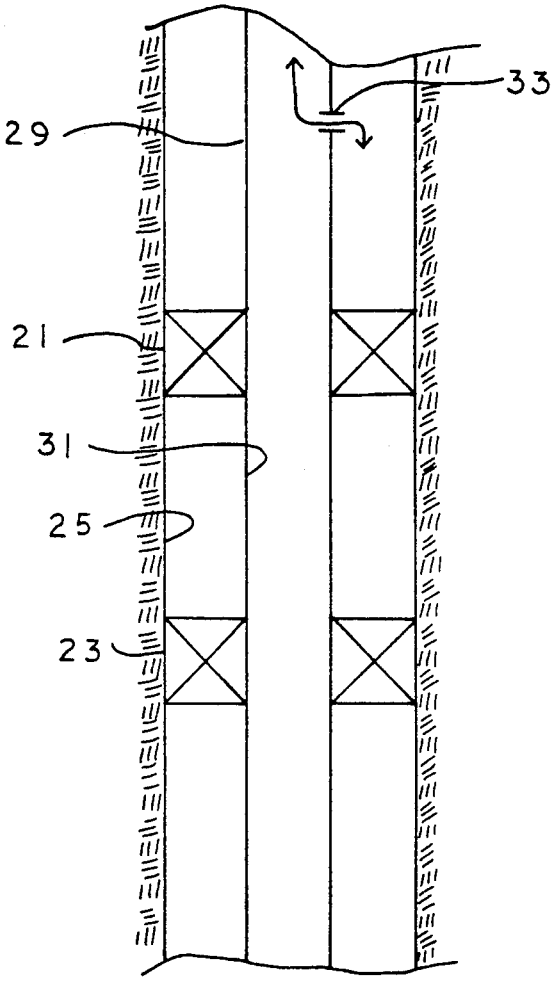
Figure 3C:
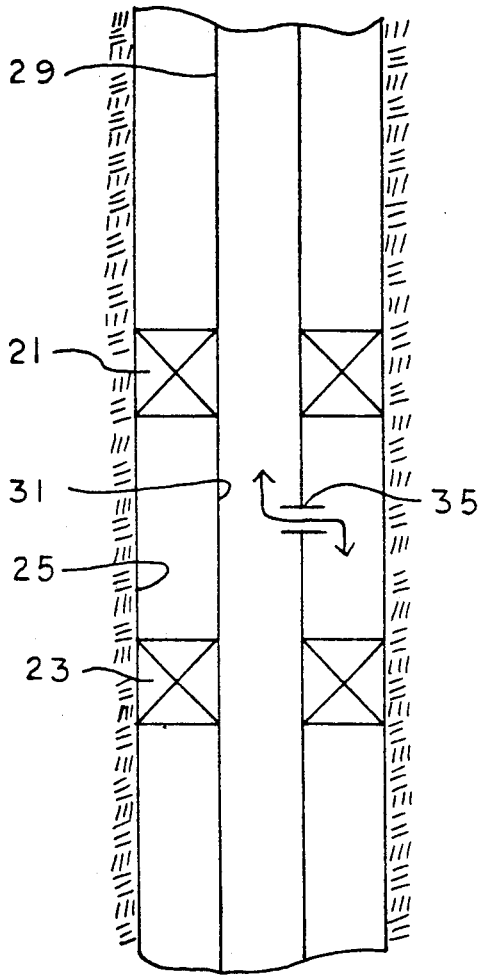

FIGS. 3*a* through 3*f* are simplified and diagrammatic views of the preferred embodiment of zone isolation tool 13 of the present invention in a plurality of differing modes of operation. FIG. 3*a* depicts an inflation/deflation mode of operation with central bore 31 of workstring 29 in fluid communication with fluid-pressure actuated seal members 21, 23 through inflation/deflation valves 39,41. FIG. 3*b* depicts an open-above mode of operation with central bore 31 of workstring 29 in fluid communication with a region above fluid-pressure actuated seal member 21, which is radially enlarged and in gripping and sealing engagement with subterranean wellbore 25, through open-above valve 33. FIG. 3*c* depicts an open-between mode of operation with central bore 31 of workstring 29 in fluid communication with a region of subterranean wellbore 25 which is between fluid-pressure actuated seal members 21, 23, which are in gripping and sealing engagement with wellbore 25, through open-between valve 35.

Figure 3D:
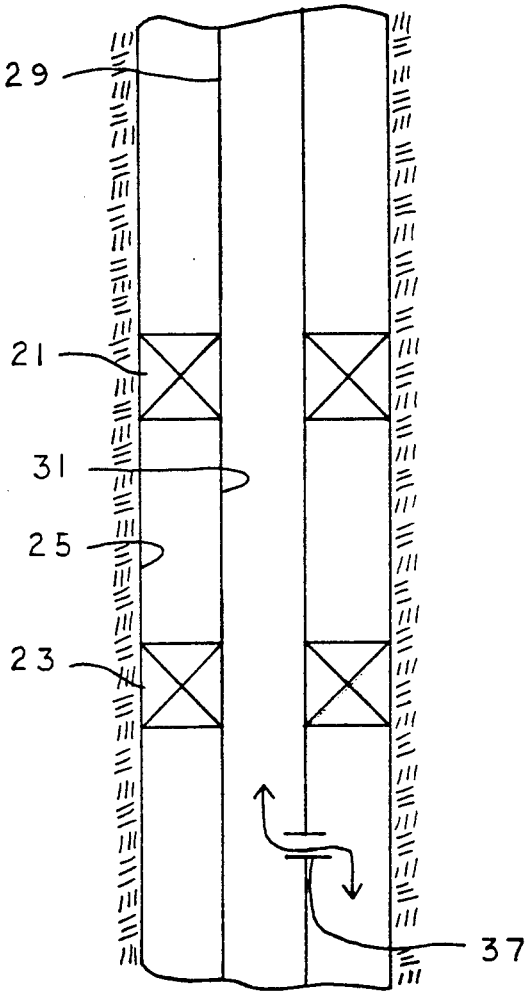
Figure 3E:
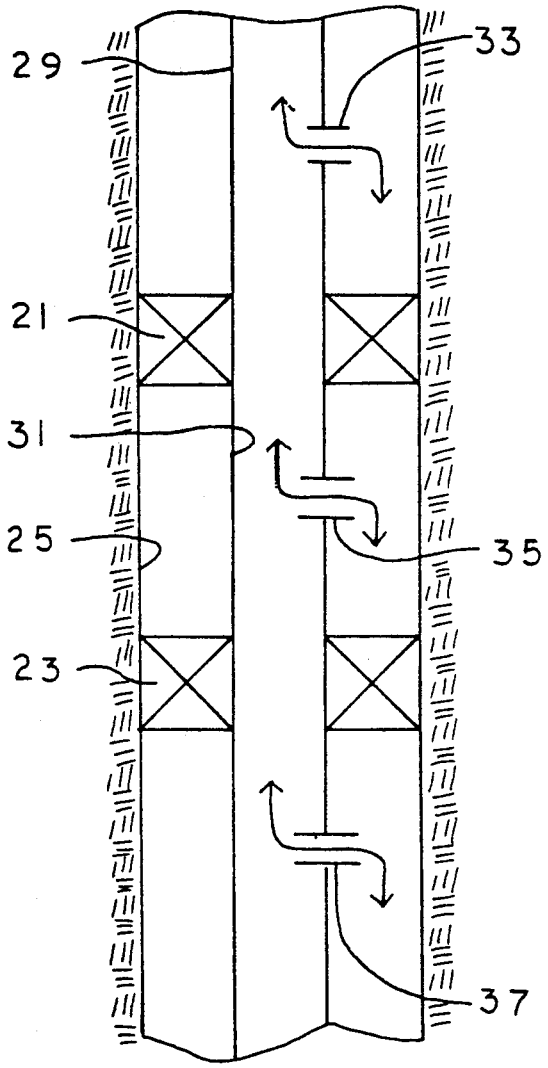
Figure 3F:
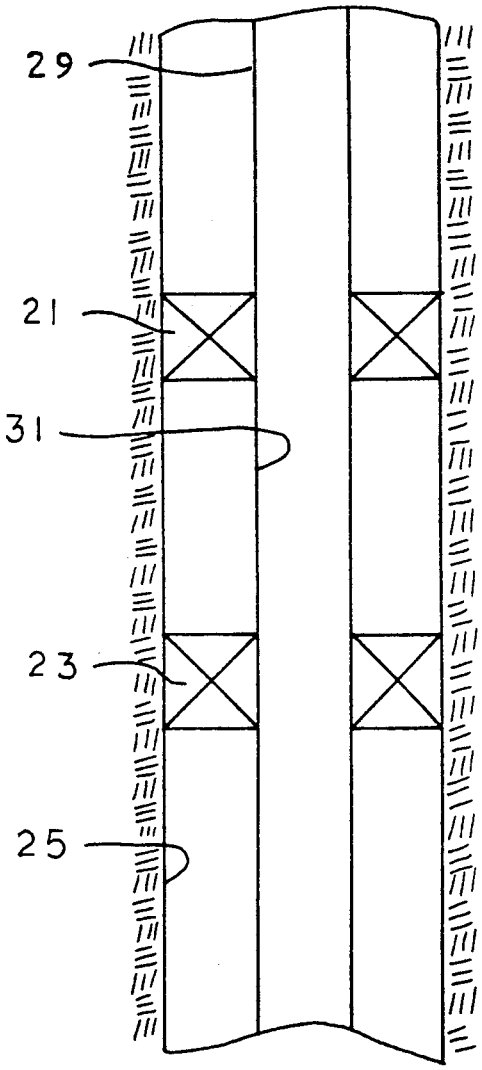

FIG. 3*d* depicts an open-below mode of operation with central bore 31 of workstring 29 in fluid communication with a region of wellbore 25 which is below fluid-pressure actuated seal member 23, which is in gripping and sealing engagement with wellbore 25, through open-below valve 37. FIG. 3*d* depicts an equalizing mode of operation with central bore 31 of workstring 29 in fluid communication with regions of subterranean wellbore 25 which are above, between, and below fluid-pressure actuated seal members 21, 23, which are in gripping and sealing engagement with wellbore 25, through open-above valve 33, open-between valve 35, and open-below valve 37 which are maintained simultaneously in open conditions to allow equalization of fluid pressure with subterranean wellbore 25. FIG. 3*f* depicts a test mode of operation with open-above valve 33, open-between valve 35, and open-below valve 37 simultaneously maintained in closed conditions to prevent communication between central bore 31 of workstring 29 and subterranean wellbore 25; this mode of operation is particularly useful in pressure testing workstring 29 and the components therein.

Figure 4A:
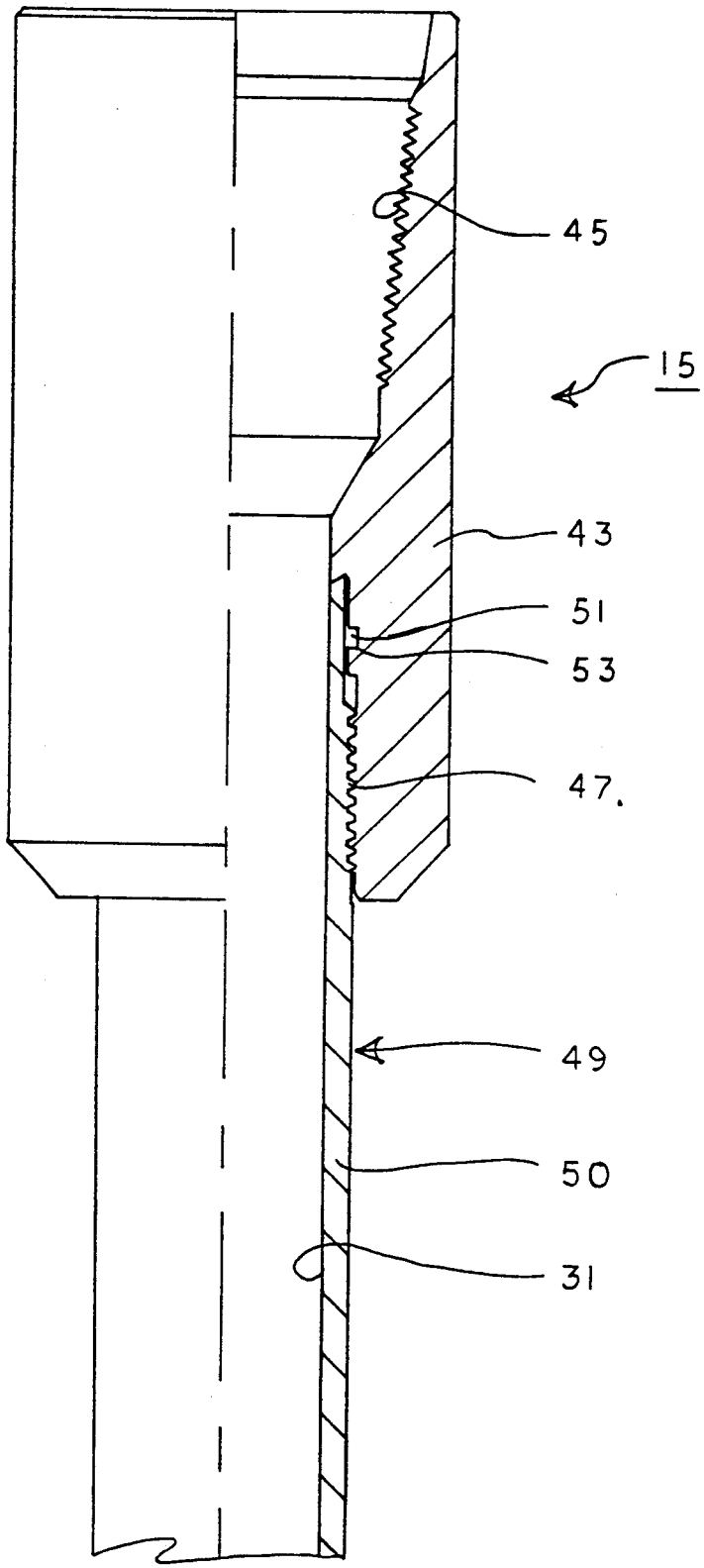
Figure 4B:
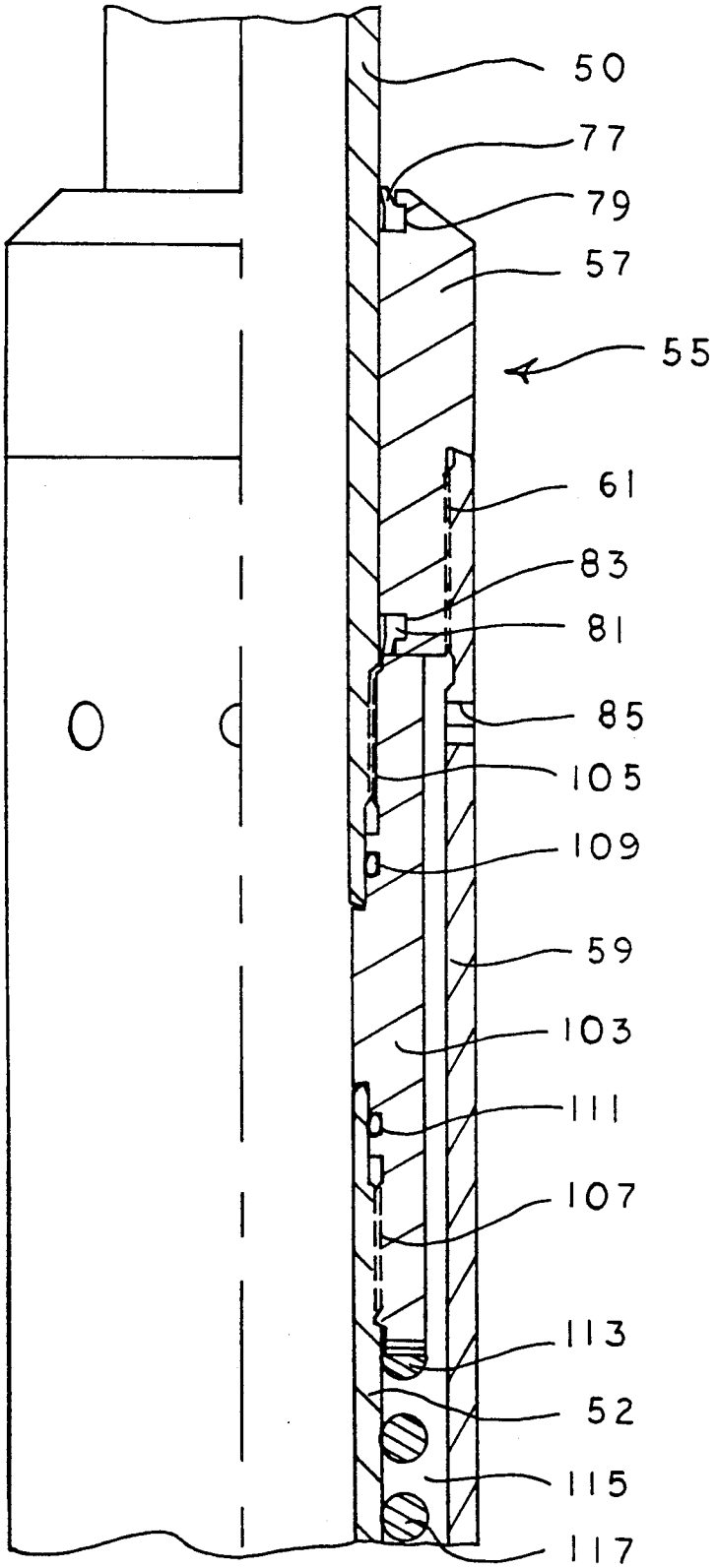
Figure 4C:
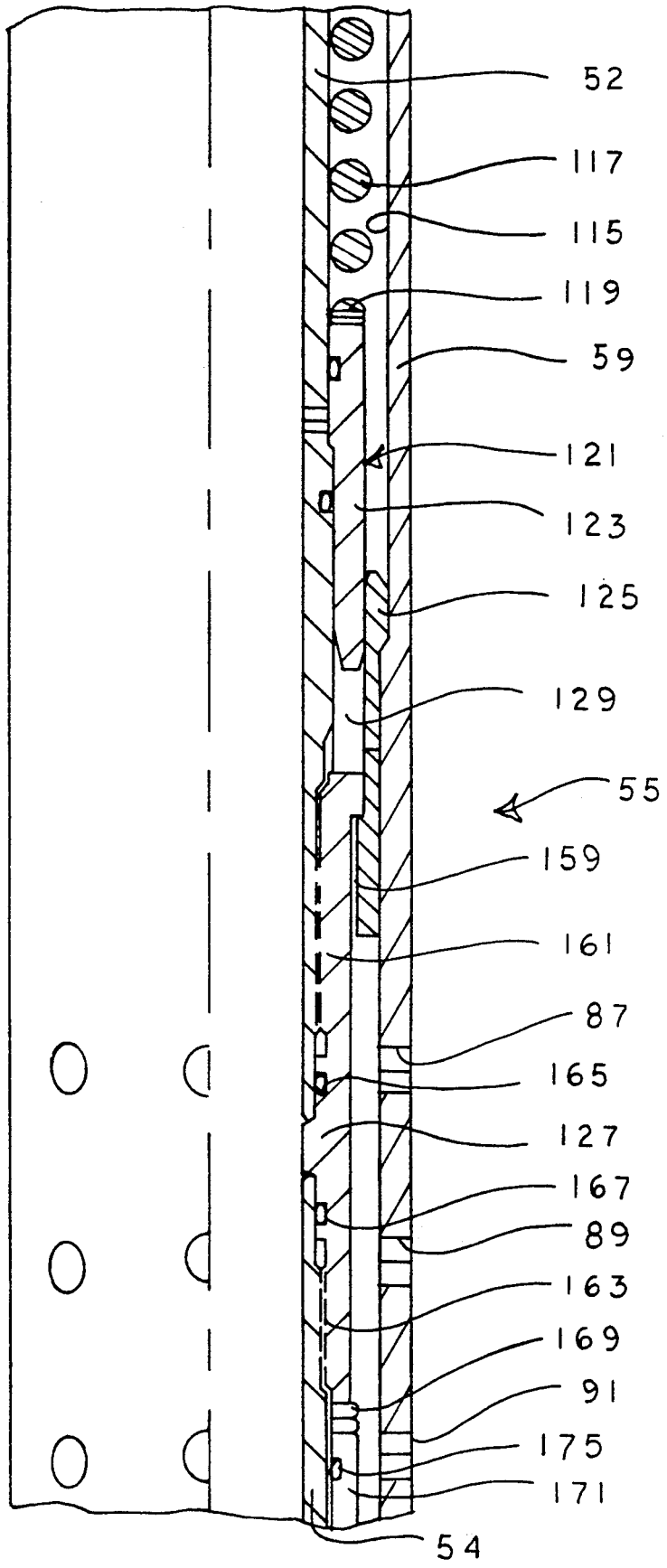
Figure 4D:
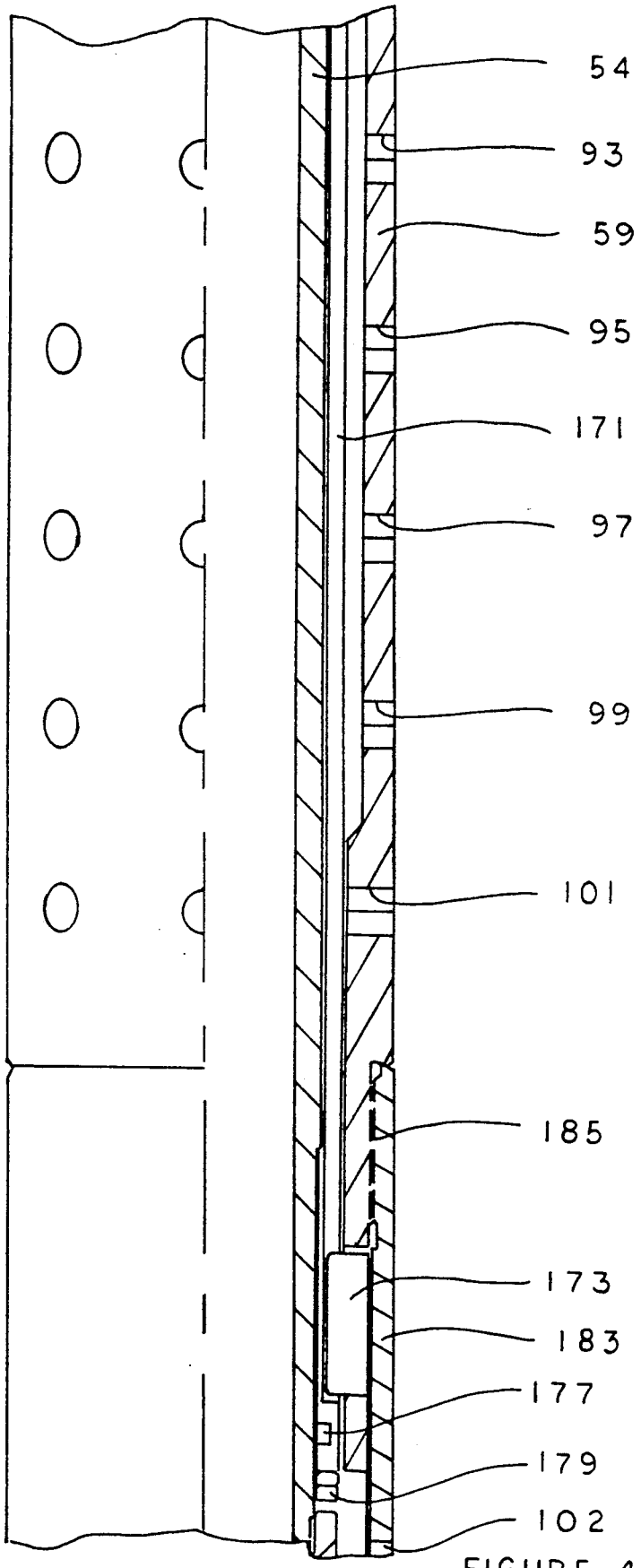
Figure 4E:
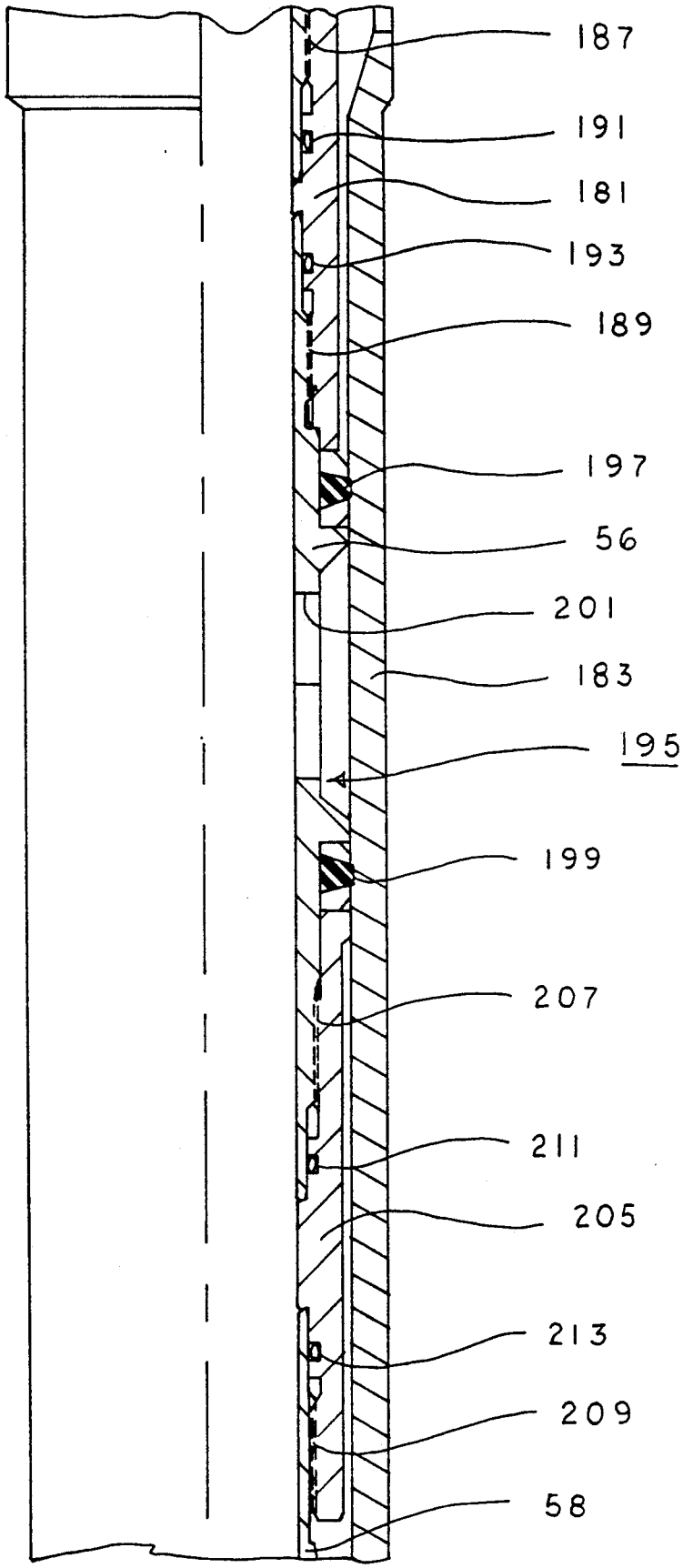
Figure 4F:
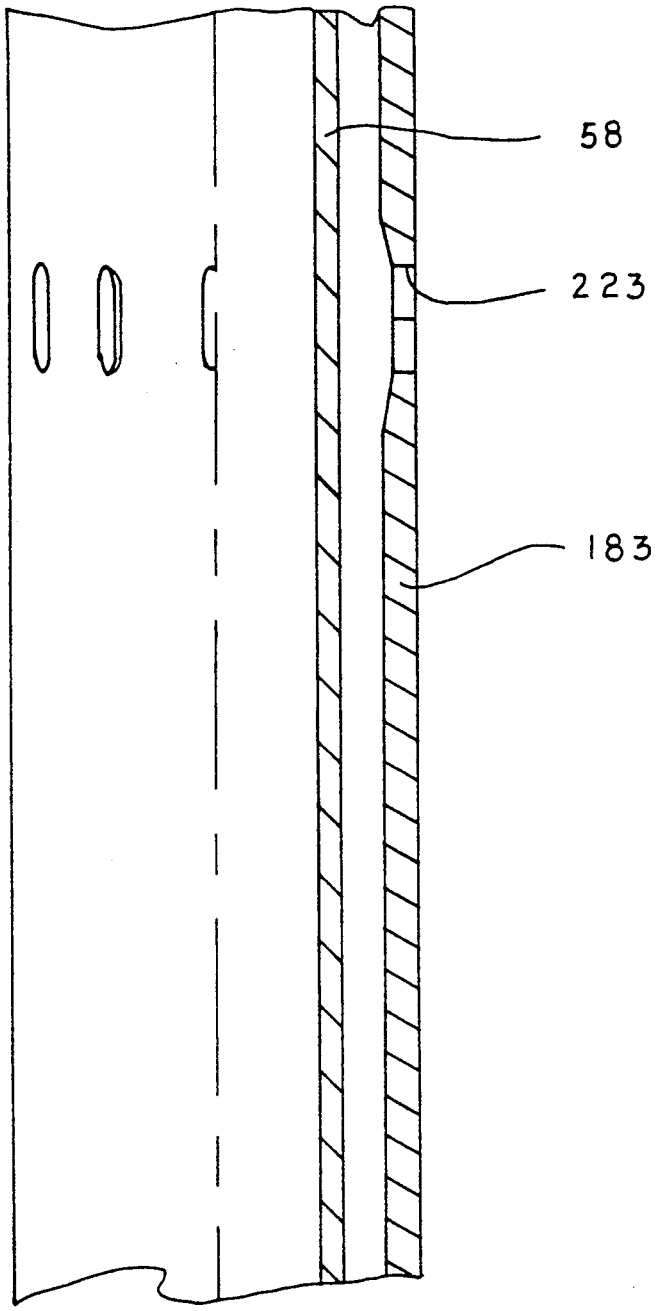

FIGS. 4*a* through 4*l* are one-quarter longitudinal section views of the preferred embodiment of upper isolator member 15 of the preferred embodiment of the zone isolation apparatus 13 of the present invention, with FIG. 4*a* representing the top of the upper isolation member 15, and FIG. 4*f* representing the bottom of upper isolator member 15, and the other figures representing intermediate portions of upper isolator member 15.

With reference first to FIG. 4*a*, upper isolation member 15 includes box collar 43 with internal threads 45 which allow for the coupling of zone isolation apparatus 13 in a selected position within a string of wellbore tubular conduit members 19 to form workstring 29. Box collar 43 is coupled to first segment 50 of segmented mandrel 49 by threaded coupling 47. As is shown in FIG. 4*a*, segmented mandrel 49 defines central bore 31 through upper isolation member 15. First segment 50 of segmented mandrel 49 and box collar 43 are sealed at their juncture by O-ring seal 51, which resides in O-ring seal cavity 53 which is formed on the interior surface of box collar 43. O-ring seal 51 prevents unintentional communication of fluids between central bore 31 and the wellbore region surrounding upper isolator member 15.

As is shown in FIGS. 4*a* and 4*b*, first segment 50 of segmented mandrel 49 extends between box collar 43 and housing 55. Housing 55 includes wiper collar 57 at its uppermost end which surrounds a portion of first segment 50 of segmented mandrel 49. Wiper collar 47 is circumferential in shape, and includes on its interior surface upper and lower wiper rings 77, 81 which are respectively disposed in wiper ring cavities 79, 83. Wiper rings 77, 81 allow wiper collar 57, and all the components coupled thereto, to rotate relative to first segment 50 of segmented mandrel 49, but prevent debris from passing into the tiny clearance between first segment 50 of segmented mandrel 49 and wiper collar 57.

Wiper collar 57 is coupled to ported outer sleeve 59 at threaded coupling 61. Ported outer sleeve 59 includes a plurality of ports which allow fluid to pass therethrough. In FIGS. 4*b*, 4*c*, and 4*d*, ports 85, 87, 89, 91, 93, 95, 97, 99, 101, and 102 in ported outer sleeve 59 are shown in longitudinal section view. Returning now to FIG. 4*b*, mandrel coupler 103 is coupled to first segment 50, and second segment 52 of segmented mandrel 49 by threaded couplings 105, 107, respectively. O-ring seals 109, 111 are provided at the interface of mandrel coupler 103 and first segment 50 and second segment 52 of segmented mandrel 49 to prevent fluid from passing through threaded couplings 105, 107. As is shown in FIG. 4b, mandrel coupler 103 abuts the lowermost end of wiper collar 57. Spring washer 113 is provided at the lowermost end of mandrel coupler 103. Spring washer 113 engages the uppermost end of spring 117 which is disposed in spring cavity 115. As is shown in FIGS. 4b and 4c, spring cavity 115 is defined between second segment 52 of segmented mandrel 49 and ported outer sleeve 59. As is shown in FIG. 4c, the lowermost end of spring 117 engages spring washer 119.

Figure 7A:
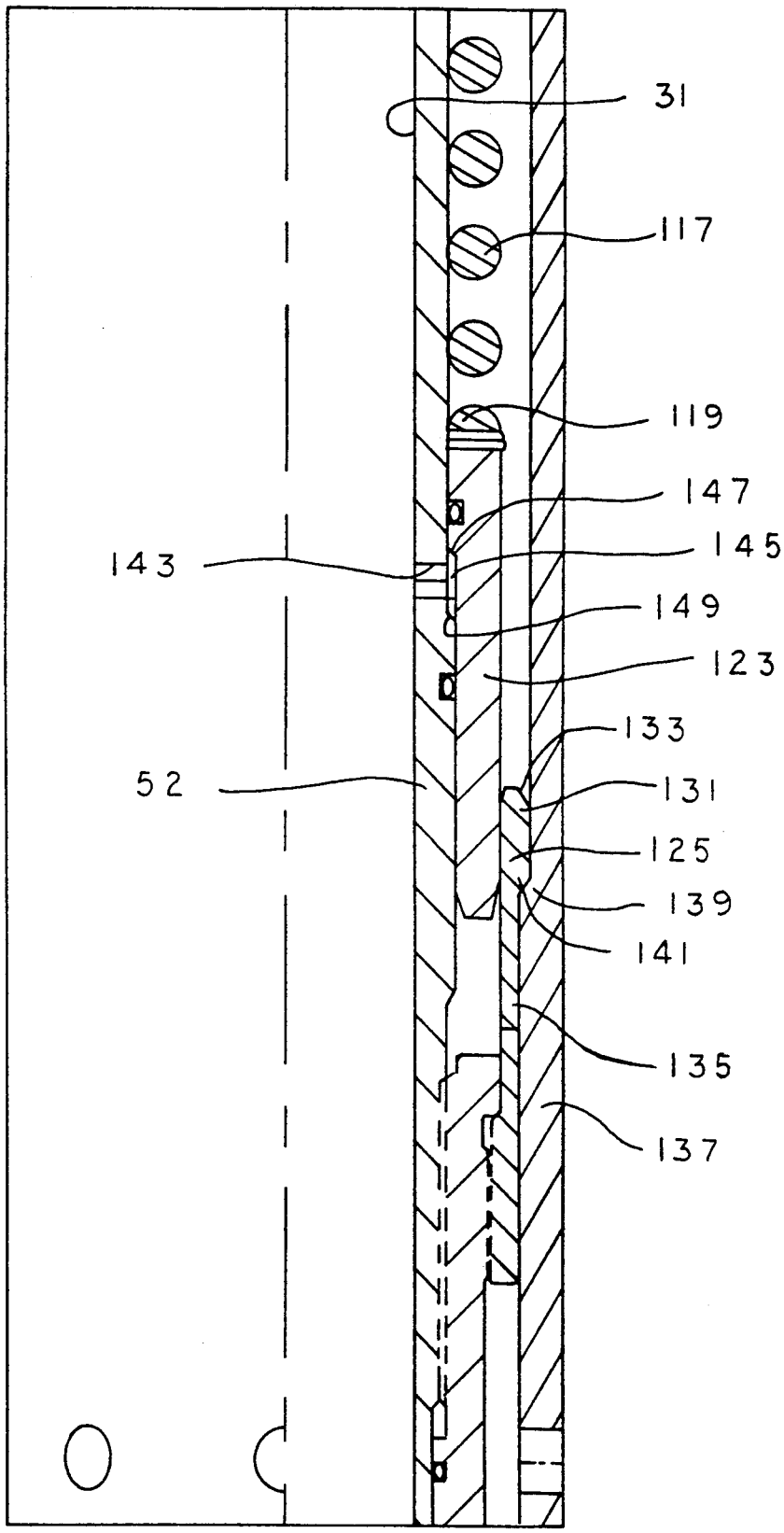
FIGS. 7*a* through 7*b* are detailed views of a latch mechanism which is a component of the preferred embodiment of the zone isolation apparatus of the present invention, in a latched condition and an unlatched condition, respectively.
Figure 7B:
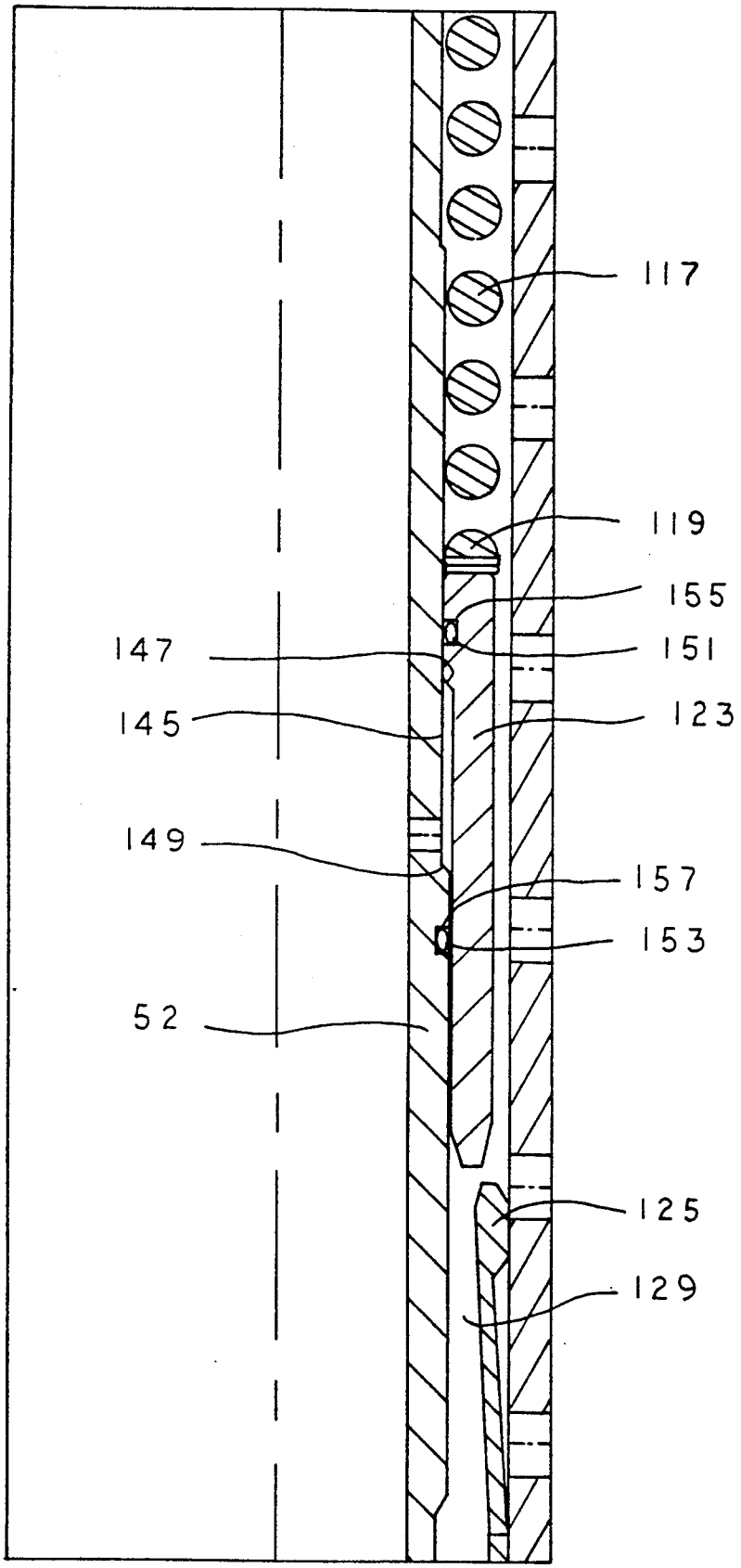

In the preferred embodiment of the present invention, zone isolation apparatus 13 includes latch member 121 which prevents axial movement of segmented mandrel 49 relative to housing 55 until a predetermined fluid pressure magnitude threshold is exceeded. Preferably, the predetermined fluid pressure magnitude threshold is sufficient to outwardly expand flexible seal members (which will be described herebelow) into sealing engagement with a selected wellbore surface. Latch member 121 is depicted in FIG. 4c and in FIGS. 7a and 7b. FIG. 7a depicts latch member 121 in a latching condition, while FIG. 7b depicts latch member 121 in an unlatched condition. In the preferred embodiment, latch member 121 includes collet member 125 which is secured through mandrel coupler 127 to second segment 52 of segmented mandrel 49. Flexure cavity 129 is provided between collet member 125 and second segment 52 of segmented mandrel 49 to allow collet member 125 to flex radially inward in response to downward axial force applied to segmented mandrel 49, unless buttress member 123 is disposed between collet member 125 and second segment 52 of segmented mandrel 49.

As is best shown in FIG. 7a, collet member 125 includes radially-enlarged collet head 131 which engages radially-reduced portion 133 of ported outer sleeve 59. Collet stem 135 engages radially-enlarged portion 137 of ported outer sleeve 59. Tapered portion 141 of collet member 125 engages tapered portion 139 of ported outer sleeve 59. As is shown in FIG. 7a, buttress member 123 engages the interior surface of collet member 125, and urges radially-enlarged collet head 131 to engage radially-reduced portion 133 of ported outer sleeve 59. With buttress member 123 disposed radially inward of collet member 125, downward axial force which is applied to segmented mandrel 49 will be transferred through collet member 125 to housing 55, thus preventing relative axial movement between segmented mandrel 49 and housing 55. In the preferred embodiment of the present invention, a plurality of collets are provided, and buttress member 123 is cylindrical in shape.

As is shown in FIG. 7a, port 143 is provided in second segment 52 of segmented mandrel 49, which allows fluid to be communicated from central bore 31 to latch cavity 145 which is defined between second segment 52 of segmented mandrel 49 and the interior surface of buttress member 123. Pressurized fluid which is supplied to latch cavity 145 will act upon buttress member 123, urging it upward relative to collet member 125. Spring 117 supplies a predetermined downward force on buttress member 123, which must be overcome by the pressurized fluid which is supplied to latch cavity 145. Latch cavity 145 defines a differential area which is defined by tapers 147, 149 in buttress member 123 and second segment 52 of segmented mandrel 49. More specifically, the surface area of taper 147 is greater than the surface area of taper 149; thus pressurized fluid will apply greater force to buttress member 123 than to second segment 52 of segmented mandrel 49, causing buttress member 123 to move upward relative to second segment 52. The predetermined surface area differential which is worked upon by the pressurized fluid determines the fluid pressure magnitude level which must be surpassed in order to overcome the bias of spring 117. In the preferred embodiment of the present invention, spring 117 should provide less than 2,000 pounds of downward force upon buttress member 123, which can be overcome easily by the application of several thousand pounds of fluid pressure force.

As is shown in FIG. 7b, application of fluid to latch cavity 145 strokes buttress member 123 axially upward, causing spring 117 to compress. O-ring 151 is provided in O-ring cavity 155 on the interior surface of buttress member 123 above taper 147. O-ring seal 153 is provided in O-ring cavity 157 on the external surface of second segment 52 of segmented mandrel 49, below taper 149. O-rings 151, 153 provide dynamic seals at the interface of buttress member 123 and second segment 52 of segmented mandrel 49, and prevent fluid from passing at the interface.

As is shown in FIG. 7b, buttress member 123 is displaced axially upward relative to collet member 125 until buttress member 123 no longer fills flexure cavity 129 between collet member 125 and second segment 52 of segmented mandrel 49. Accordingly, collet member 125 may flex radially inward in response to downward axial force applied to segmented mandrel 49.

As is shown in FIG. 4c, collet member 125 is connected by threads 159 to mandrel coupler 127. Mandrel coupler 127 is coupled at its uppermost end by threaded coupling 161 to second segment 52 of segmented mandrel 49, and is coupled at its lowermost end by threaded coupling 163 to third segment 54 of segmented mandrel 49. O-ring seals 165, 167 are provided at the interface of mandrel coupler 127, second segment 52, and third segment 54 to prevent fluid leakage at this interface.

Spacer 169 is provided between the lowermost end of mandrel coupler 127 and cylindrical track member 171. As is shown in FIG. 4d, lug member 173 is adapted to slidably engage cylindrical track member 171. The relative axial and radial positions of cylindrical track member 171 and lug member 173 establish the operating states of the preferred embodiment of zone isolation apparatus 13 of the present invention. As was discussed above with regard to FIGS. 3a through 3f, six operating conditions exist, including: an inflation/deflation mode of operation; an open-above mode of operation; an open-between mode of operation; an open-below mode of operation; an equalizing mode of operation; and a test mode of operation. As is shown in FIGS. 4c and 4d, lug member 173 forms a part of housing 55, while cylindrical track member 171 is coupled to segmented mandrel 49. Upward and downward axial movement of segmented mandrel 49 will cause cylindrical track member 171 to move relative to lug member 173. In this way, upper and lower isolation members 15, 17 may be stationary with respect to a selected wellbore surface, while workstring 29 is manipulated axially to move the zone isolation apparatus 13 of the present invention through the various operating modes. This feature is more clearly illustrated in FIGS. 6a through 6f which are plan views of cylindrical track member 171 rolled-out in a single plane. In these views, lug member 173 is represented by a token.

Figure 6A:
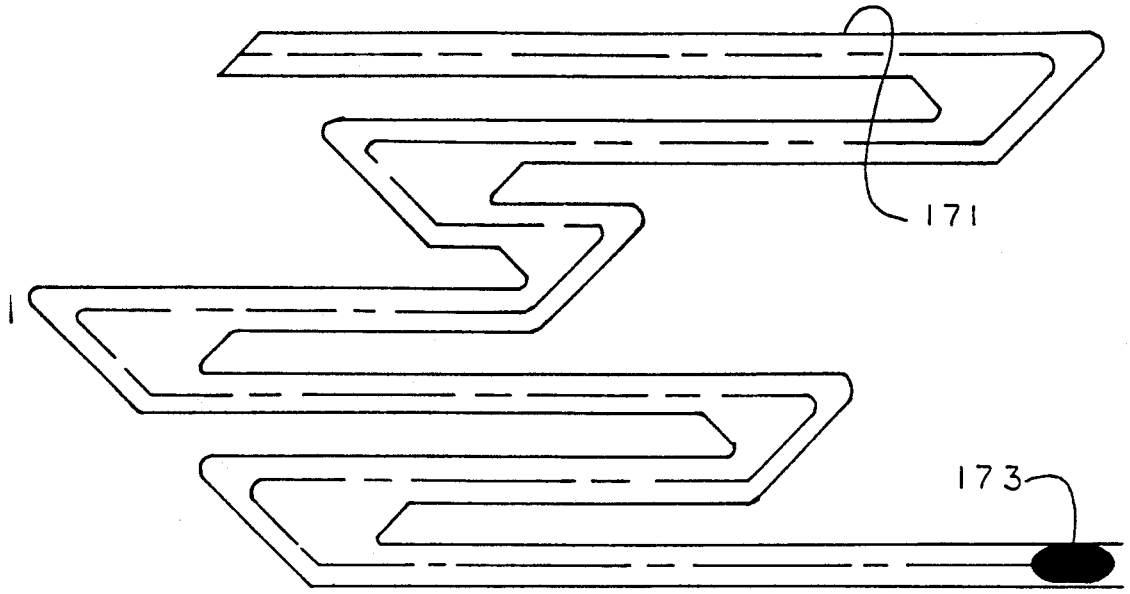
FIGS. 6*a* through 6*f* are plan views of a track-and-lug connector which is provided in the upper isolator member of the preferred embodiment of the zone isolation apparatus of the present invention, representing six differing modes of operation.
Figure 6B:
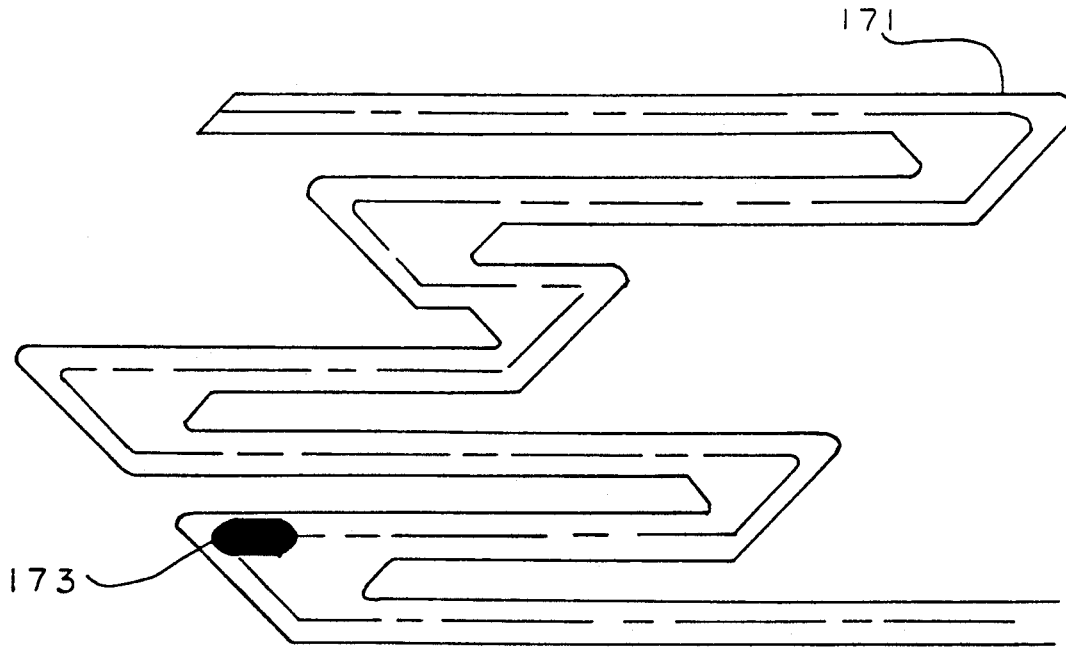
Figure 6C:
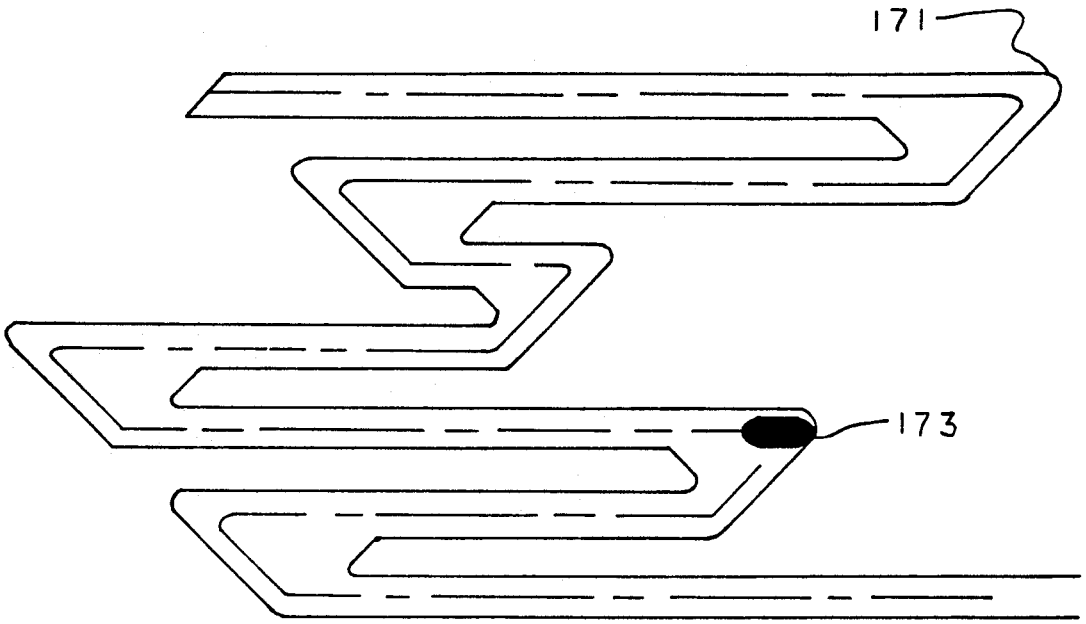
Figure 6D:
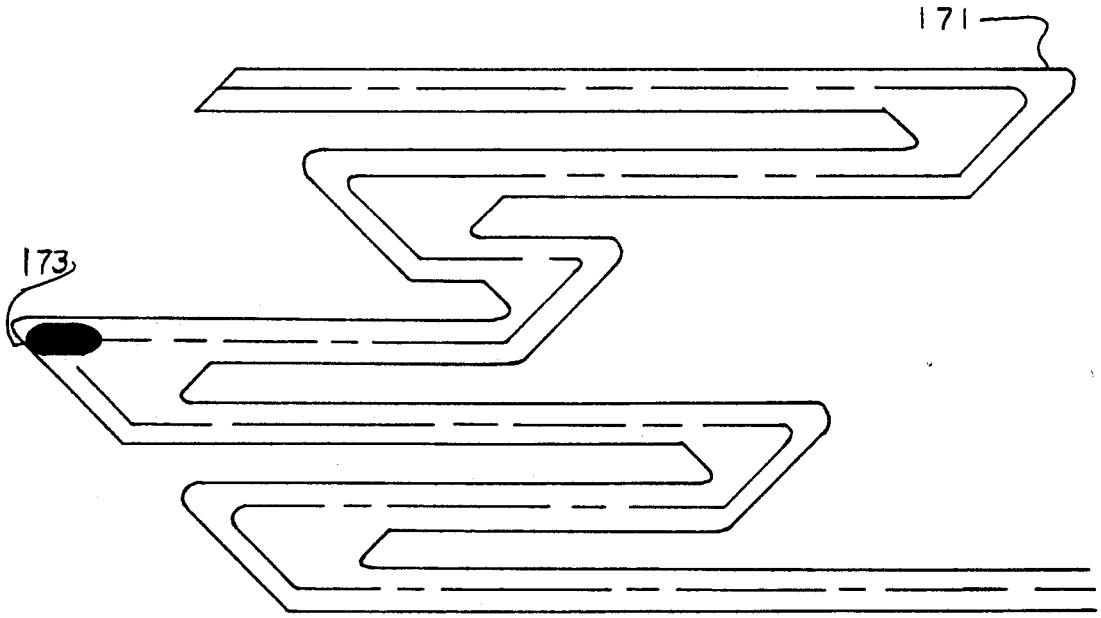
Figure 6E:
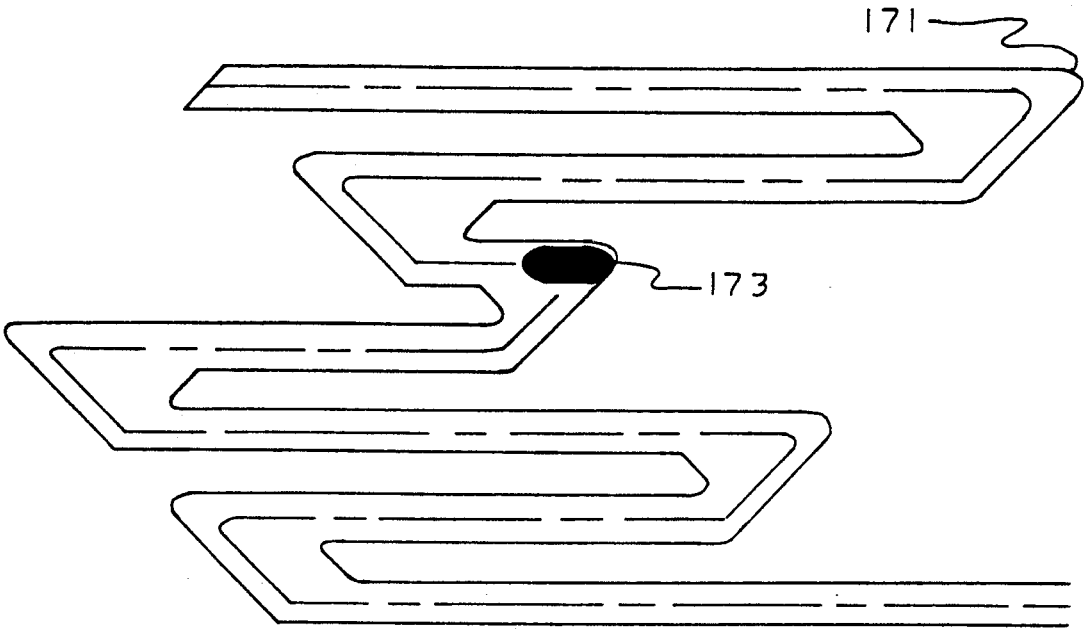
Figure 6F:
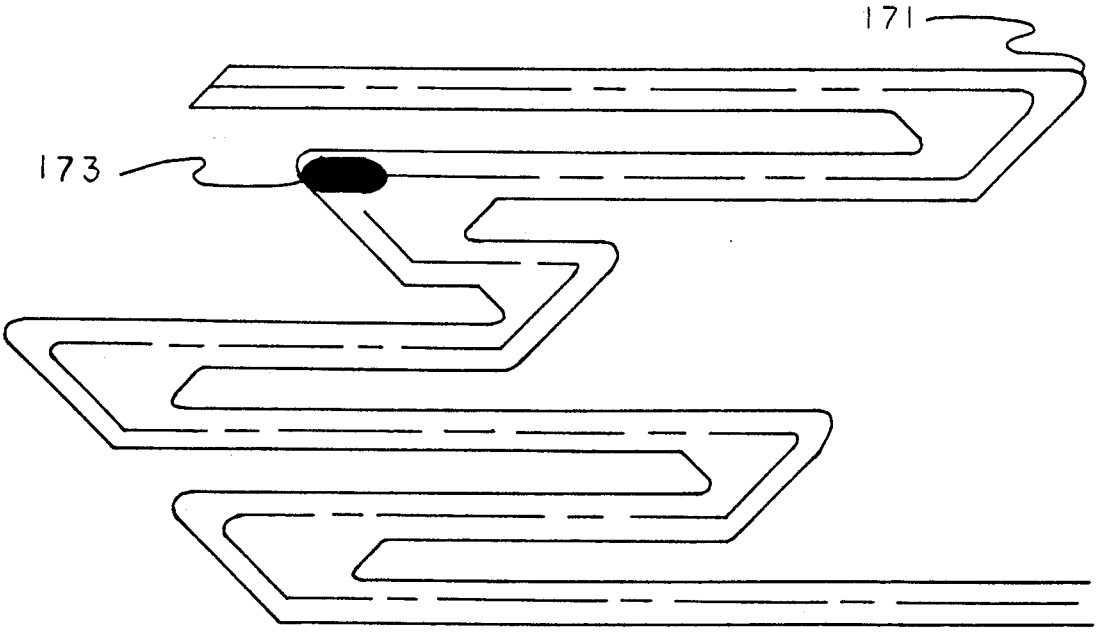

FIG. 6*a* represents the inflation/deflation mode of operation, with lug member 173 disposed at a lower portion of cylindrical track member 171. Moving cylindrical track member 171 downward relative to lug 173 will move the zone isolation apparatus 13 from the inflation/deflation mode of operation, of FIG. 6*a*, to the open-above mode of operation, which is depicted in FIG. 6*b*. Pulling cylindrical track member 171 upward relative to lug member 173 will switch the zone isolation apparatus 13 of the present invention between the open-above mode of operation of FIG. 6*b* to the open-between mode of operation which is depicted in FIG. 6*c*. Moving cylindrical track member 171 downward relative to lug member 173 will switch the zone isolation apparatus 13 of the present invention between the open-between mode of operation of FIG. 6*e* to the open-below mode of operation which is depicted in FIG. 6*d*. Pulling upward on cylindrical track member 171 relative to lug member 173 will switch the zone isolation apparatus 13 of the present invention between the open-below mode of operation of FIG. 6*d* to the equalizing mode of operation of FIG. 6*e*. Moving cylindrical track member 171 downward relative to lug member 173 will switch the zone isolation apparatus 13 of the present invention between the equalizing mode of operation of FIG. 6*e* to the test mode of operation of FIG. 6*f*. Moving cylindrical track member 171 upward relative to lug member 173 will switch the zone isolation apparatus 13 of the present invention from the test mode of operation of FIG. 6*f* to the inflation/deflation mode of operation of FIG. 6*a*.

It can be appreciated that the arrangement of cylindrical track member 171 establishes a plurality of stations which correspond to operating conditions for the zone isolation apparatus 13, and that the zone isolation apparatus 13 can be moved between various modes of operation by application of axial force only. It can be further appreciated that cylindrical track member 171 establishes a predetermined sequence of operating states which can be obtained with the zone isolation apparatus 13 of the present invention. In other embodiments of the present invention, the operating modes can be arranged in a different predetermined order. Alternatively, one or more operating modes may be omitted, or one or more operating modes may be added.

As is shown in FIGS. 4*c* and 4*d*, cylindrical track member 171 is positioned between mandrel coupler 127 and mandrel coupler 181. O-ring seals 175, 177 are provided at the upper and lower ends of cylindrical track member 171 to provide a debris barrier member 171 and second and third segments 52, 54 of segmented mandrel 49. Spacer 179 is provided at the lowermost end of cylindrical track member 171. Also, in the preferred embodiment, lug member 173 is disposed in a gap between the lowermost end of ported outer sleeve 59 and seal mandrel 183, which are coupled together at threaded coupling 185. As is shown in FIGS. 4*d* and 4*e*, mandrel coupler 181 connects third segment 54 and fourth segment 56 of segmented mandrel 49 at threaded couplings 185, 187. O-ring seals 101, 193 are provided at the interface of mandrel coupler 181 and third segment 54 and fourth segment 56 to prevent leakage of fluid through threaded couplings 187, 189.

Figure 4G:
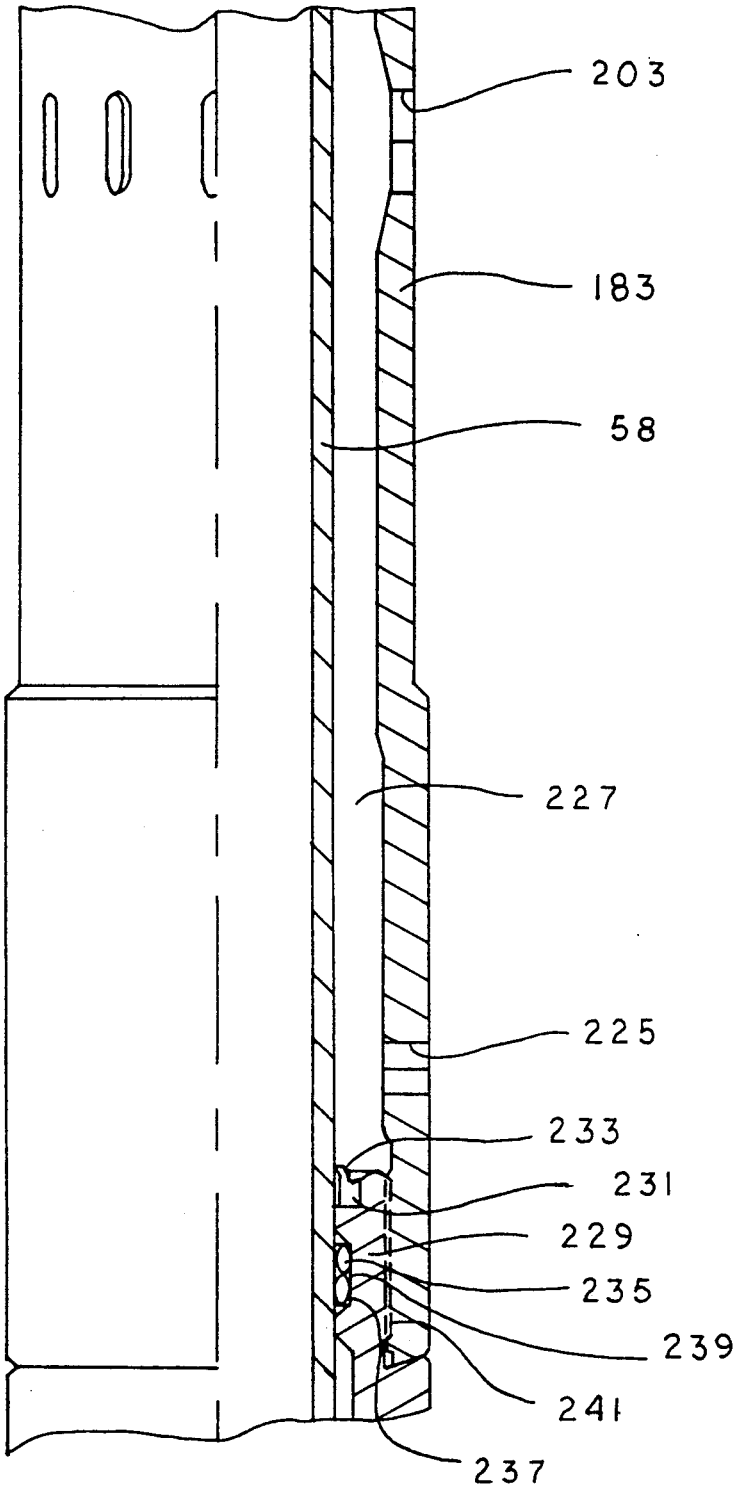
Figure 4H:
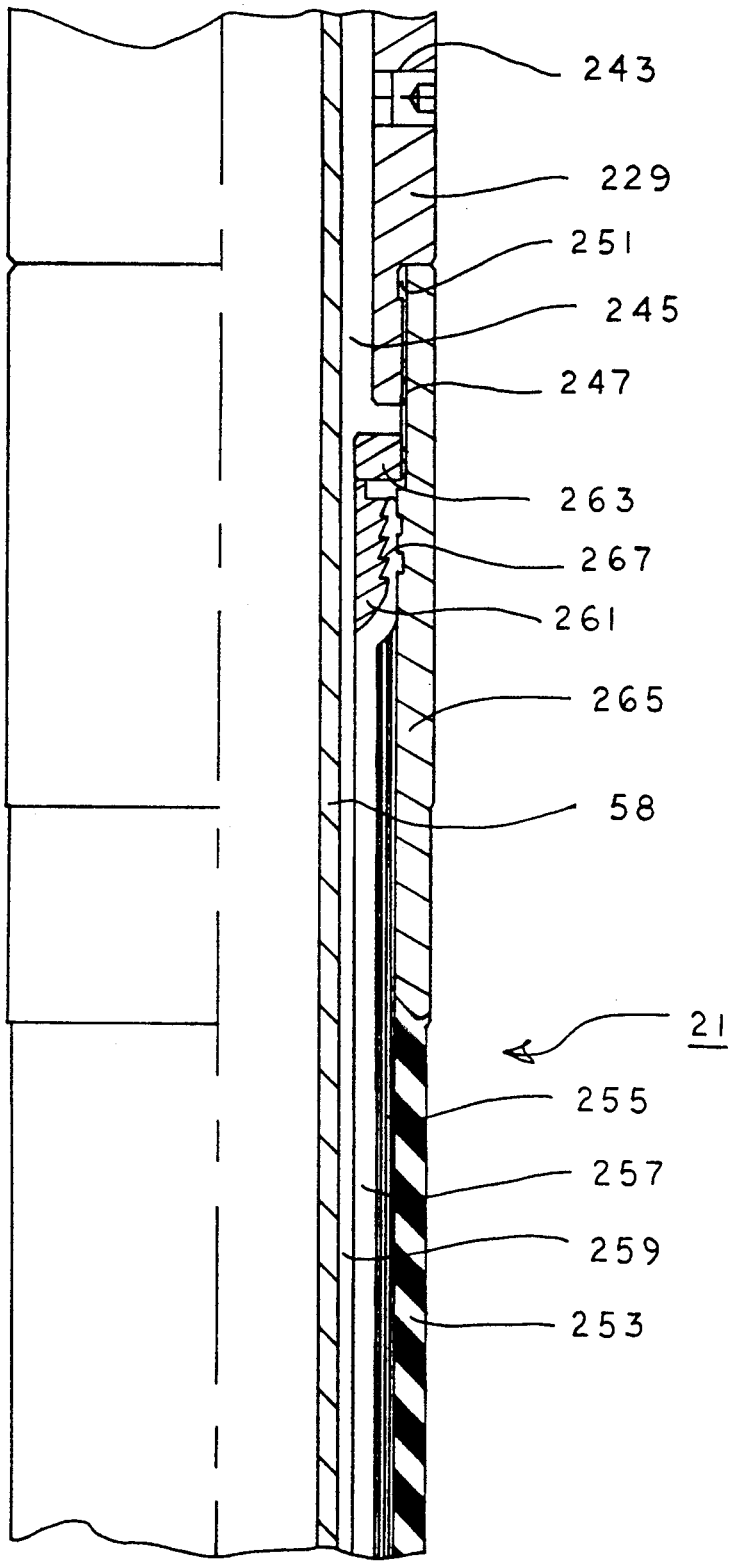

As is shown in FIG. 4*e*, open-above valve 195 is defined in fourth segment 56, and includes upper seal 197, and lower seal 199, which straddle port 201. Preferably, upper and lower seals 197, 199 include elastomeric components which allow for a dynamic and fluid-tight seal with the interior surface of seal mandrel 183. Open-above valve 195 may be displaced axially downward relative to seal mandrel 183 to align port 201 with open-above port 203 in seal mandrel 183, which is shown in FIG. 4*g*. In this configuration, upper seal 197 is disposed above open-above port 203 and is in sealing engagement with the interior surface of seal mandrel 183. Lower seal 199 would be below open-above port 203, and in sealing engagement with the interior surface of seal mandrel 183. As is shown in FIG. 4*e*, mandrel coupler 205 is provided for coupling fourth segment 56 and fifth segment 58 of segmented mandrel 49 at threaded couplings 207, 209. O-ring seals 211, 213 are provided to prevent the passage of fluid through threaded couplings 207, 209.

Figure 10:
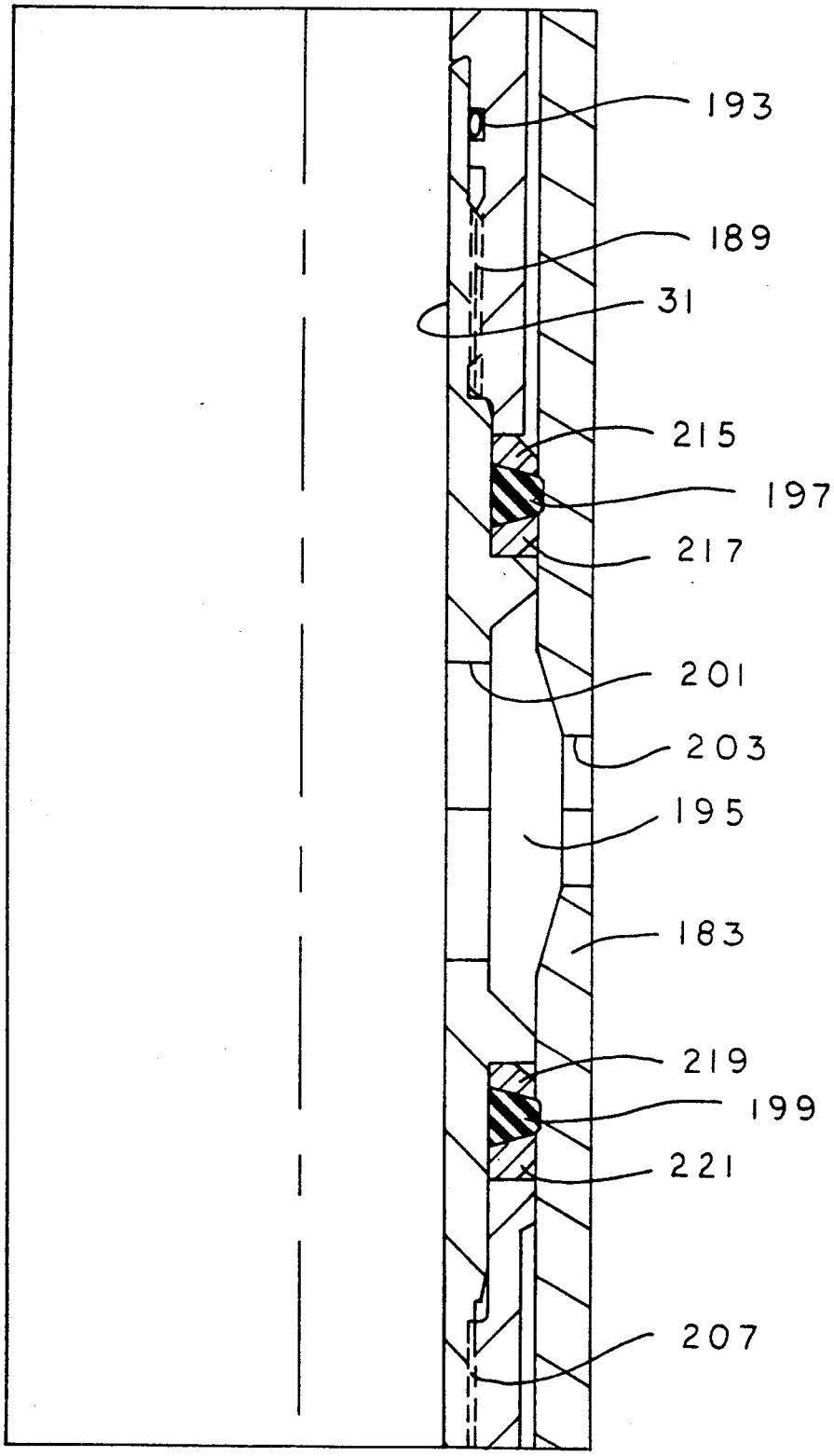
FIG. 10 is a detail view of the open-above port of the preferred embodiment of the zone isolation apparatus of the present invention.

FIG. 10 is a detail view of open-above valve 195 with port 201 in alignment with open-above port 203 to allow fluid communication between central bore 31 of zone isolation apparatus 13 and the wellbore region exterior of seal mandrel 183. Note that upper and lower seals 197, 199 include a substantially rectangular (in cross-section view) elastomeric component which is disposed between retainer rings 215, 217, 219, 221. The alignment of port 201 with open-above port 203 establishes the open-above mode of operation with fluid communicating between central bore 31 and an annular region above upper isolator member 15 of zone isolation apparatus 13. As discussed above, the open-above mode of operation requires a positioning of lug member 173 relative to cylindrical track member 171 which corresponds to that of the view of FIG. 6*b*. After passing through intermediate operating modes, the zone isolation apparatus 13 may be moved to an equalizing mode of operation wherein open-above valve 195 is aligned with equalizing valve 223 of FIG. 4*f*. In this configuration, fluid may communicate between bore 31 and the region exterior of seal mandrel 183, just as during the open-above mode of operation. However, in the equalizing mode of operation, other valves are simultaneously open, as will be discussed herebelow.

Returning now to FIG. 4*g*, vent port 225 is provided in seal mandrel 183 to allow fluid to be discharged from cavity 227 as open-above valve 195 is moved downward relative to seal mandrel 183. Wiper and seal assembly 229 substantially defines the lowermost end of cavity 227, and includes wiper ring 231 which resides in wiper ring cavity 233, and dynamic elastomeric seals 235, 237 which reside in seal cavity 239 on the interior surface of wiper and seal assembly 229. Wiper and seal assembly 229 is coupled by threaded coupling 241 to the lowermost end of seal mandrel 183. Wiper and seal assembly 229 further includes tap-in port 243 which allows for selective fluid communication between cavity 245 and regions exterior of wiper and seal assembly 229. At its lowermost end, wiper and seal assembly 229 is coupled to upper collar of fluid-pressure actuated seal member 21 by threaded coupling 247. Seals 251 prevent leakage at threaded coupling 247.

In the preferred embodiment of the present invention, fluid-pressure actuated seal member 21 includes outer elastomeric cylindrical layer 253 which extends over a plurality of flexible and partially-overlapping reinforcement slats 255, which are disposed over inner elastomeric circumferential layer 257. These components reside over inflation chamber 259 which is adapted for receiving fluid and which is defined radially inward by fifth segment 58 of segmented mandrel 49. Outer elastomeric circumferential layer 253, flexible and partially-overlapping reinforcement slats 255 and inner elastomeric layer 257 are secured in position relative to the zone isolation apparatus 13 between gripping ring 261 which includes a plurality of gripping teeth 267 and upper collar 265. Retaining ring 263 retains gripping ring 261 in a fixed position relative to upper collar 265 and couples to upper collar 265 at threaded coupling 247.

Figure 4I:
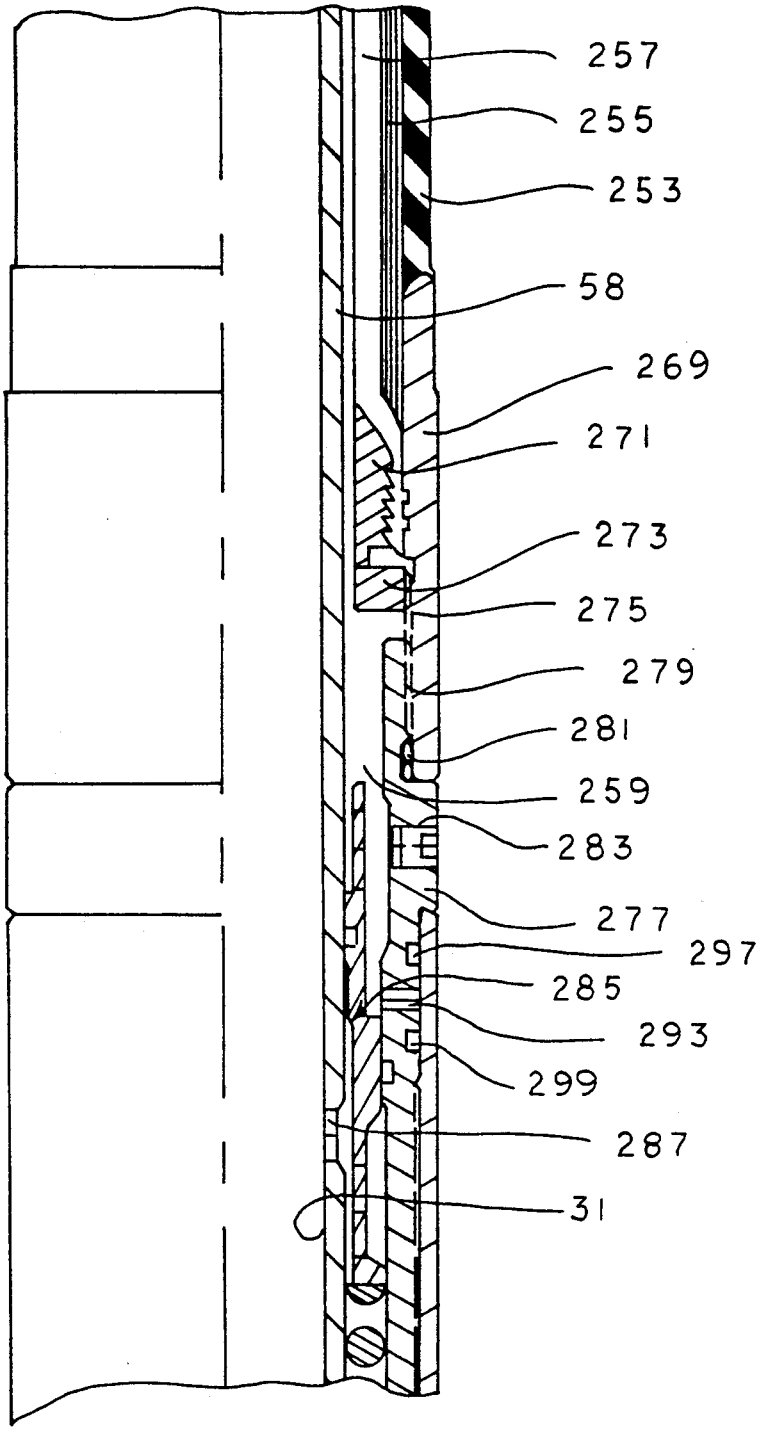

FIG. 4*i* depicts the lowermost portion of fluid-pressure actuated seal member 21, with outer elastomeric cylindrical layer 253, flexible partially-overlapping reinforcement slats 255, and inner elastomeric layer 257 secured between lower collar 269 and gripping ring 271. Gripping ring 271 is secured in position relative to lower collar 269 by retainer ring 273. Retainer ring 273 is secured to lower collar 269 by threaded coupling 275. Lower collar 269 is secured to housing coupler 277 at threaded coupling 279. Fluid is prevented from passing through threaded coupling 279 by seals 281. Selectively operable tap-in port 283 extends through housing coupler 277 allows for selective communication with inflation chamber 259 of fluid-pressure actuated seal member 21.

Inflation control mechanism 285 prevents the passage of fluid from central bore 31 through inflation port 287 in fifth segment 58 of segmented mandrel 49 until a predetermined fluid pressure amplitude threshold is exceeded by fluid that is carried in central bore 31. The operation of inflation control mechanism 285 can be best understood with reference to FIG. 9, which is a detail view of inflation control mechanism 285. As is shown, housing coupler 277 is secured by threaded coupling 291 to lower housing mandrel 289. Shear screw port 293 extends through housing coupler 277, and is adapted for receiving shear screw 295. O-ring seals 297, 299 are disposed above and below shear screw port 293, to prevent shear screw port 293 from becoming a leak path. Upper portion 301 of lower housing mandrel 289 extends over O-ring seals 297, 299, and abuts housing coupler 277 at shoulder 303.

Figure 9:
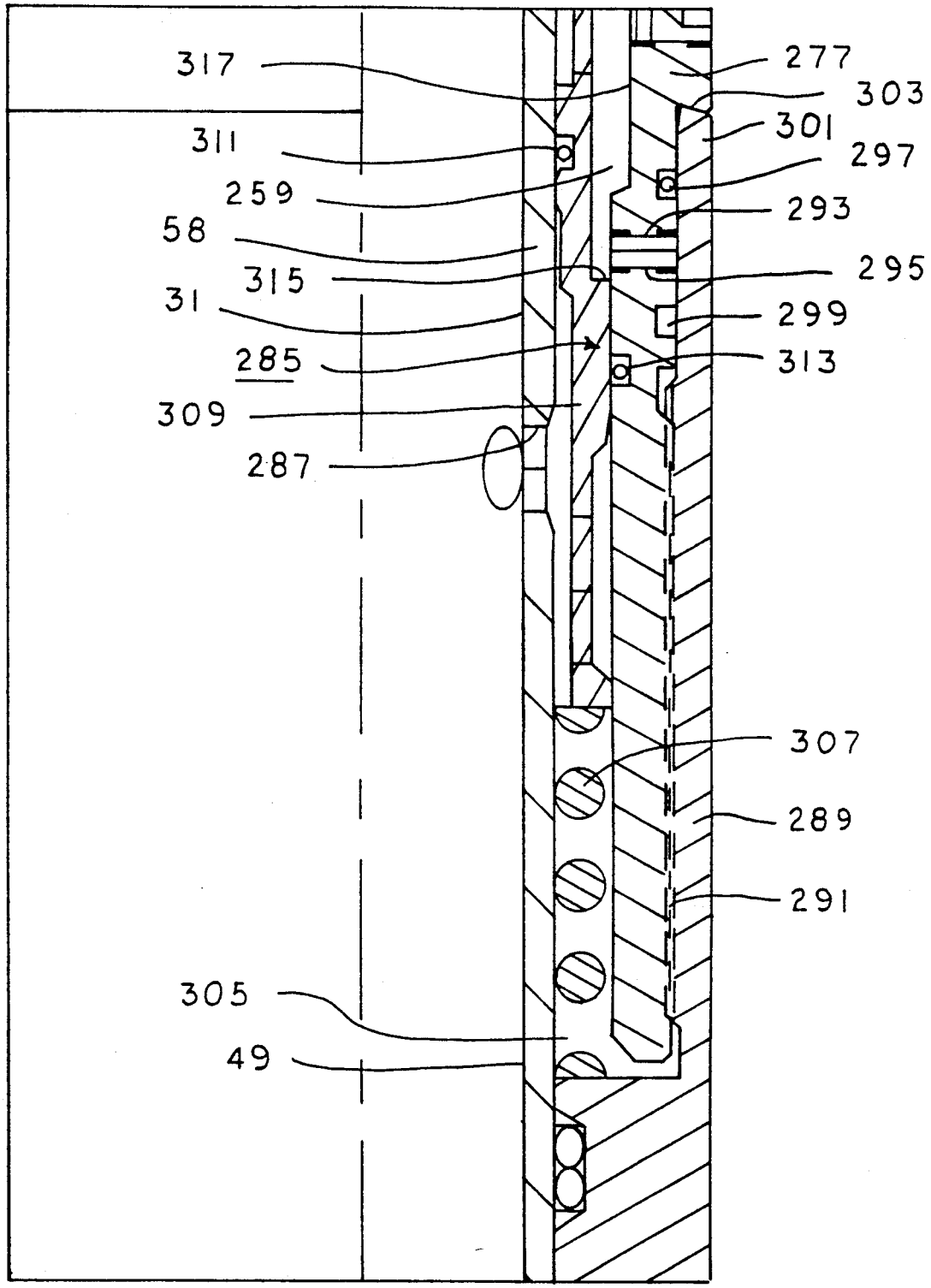
FIG. 9 is a detail view of the inflation port of the preferred embodiment of the zone isolation apparatus of the present invention.

As is shown in FIG. 9, piston member 309 is disposed between fifth segment 58 of segmented mandrel 49 and housing coupler 277. Piston member 309 serves as a temporary plug to prevent the passage of fluid from central bore 31, through inflation port 287, to inflation chamber 259. O-ring seal 311, which is provided on the interior surface of piston member 309, sealingly and dynamically engages the exterior surface of fifth segment 58 of segmented mandrel 49 above inflation port 287 to prevent fluid leakage at the interface of these components. The exterior surface of piston member 309 is dynamically and sealingly engaged by O-ring seal 313 which is carried on the interior surface of housing coupler 277.

Piston member 309 includes profile 315 on its exterior surface which engages the lowermost end of shear screw 295. Spring 307 engages the lowermost end of piston 309, and causes profile 315 to firmly engage the lowermost end of shear screw 295. High pressure fluid which is carried by central bore 31 will enter spring cavity 305 through inflation port 287, and apply an upward axial force on piston member 309. When the force acting on piston member 309 exceeds the shear threshold of shear screw 295, the lowermost end of shear screw 295 will be sheared off, and piston member 309 will be stroked upward toward radially reduced portion 317 of piston member 309, until fluid is allowed to pass around piston member 309 and into inflation chamber 259.

The fluid pressure amplitude threshold which must be obtained in order to allow fluid to flow into inflation chamber 259 can be established by selecting shear screw 295 as well as the surface area of piston member 309 which is exposed to high pressure fluid. Preferably, the fluid amplitude threshold which must be obtained in order to initiate inflation of fluid-pressure actuated seal member 21 should be below the fluid pressure amplitude threshold which is required to switch latch member (of FIG. 7*a* and 7*b*) between coupled and uncoupled conditions. This ensures that fluid-pressure actuated seal member 21 will begin inflation well below the fluid pressure amplitude threshold which must be obtained in order to allow axial movement of segmented mandrel 49 relative to housing 55. As was discussed above, when fluid-pressure actuated seal member 21 is fully inflated, the predetermined fluid pressure amplitude threshold for latch member 121 is exceeded, allowing axial movement of segmented mandrel 49 relative to housing 55. This allows the switching of zone isolation apparatus 13 into other predetermined modes of operation.

It is especially important that fluid-pressure actuated seal member 21 be fully inflated and in gripping and sealing engagement with a selected wellbore surface before other modes of operation are available. In all the modes of operation, except the inflation/deflation mode of operation, inflation chamber 259 is maintained out of communication with central bore 31 in order to prevent deflation of fluid-pressure actuated seal members 21. In order to advance to the open-above mode of operation, which is graphically depicted in FIG. 6*b*, segmented mandrel 49 will move downward relative to piston member 309 and housing coupler 277 into a position which maintains inflation port 287 out of communication with inflation chamber 259, as can best be seen with reference to FIGS. 4*i* and 4*j*. In all modes of operation, except the inflation/deflation mode of operation, inflation port 287 is maintained in a position below inflation seal 319 which is carried by lower housing mandrel 289.

Figure 4J:
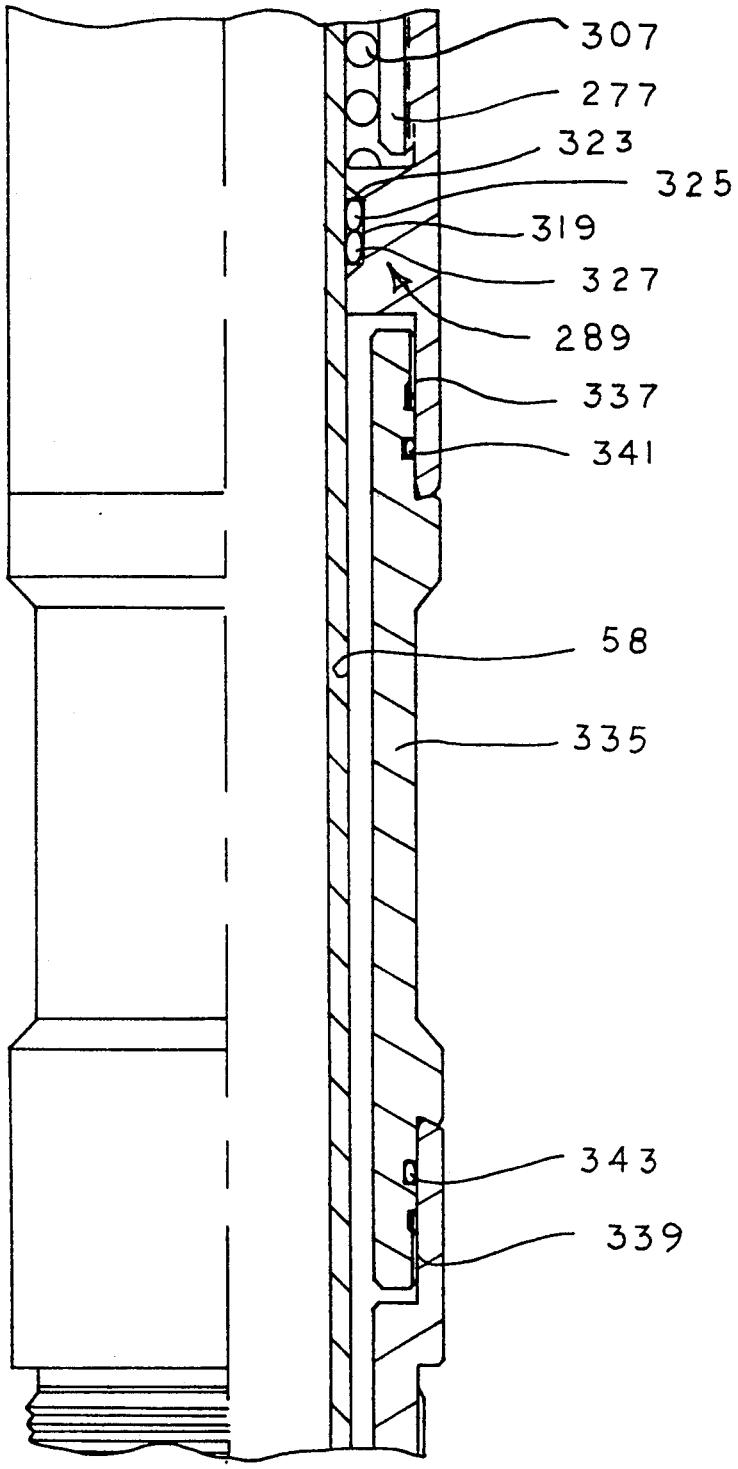

With reference now to FIG. 4*i* and 4*j*, as fluid-pressure actuated seal member 21 is expanded radially outward from fifth segment 58 of segmented mandrel 49, an upward axial force will be applied to lower collar 269 and gripping ring 271. Housing coupler 277 and lower housing mandrel 289 (which are coupled together) will be urged to move upward relative to fifth segment 58 of segmented mandrel 49.

With reference now to FIGS. 4*i*, 4*j*, 4*k*, and 4*l*, lower housing mandrel 289 is composed of a plurality of components which are coupled together and which cooperate to define upper and lower inflation seals 319, 321. Upper inflation seal 319 includes O-ring seals 325, 327 which are disposed in seal cavity 323. Lower inflation seal 321 includes O-ring seals 331, 333, which are disposed in seal cavity 329. Upper and lower inflation seals 319, 321 provide dynamic seals which engage the exterior surface of fifth segment 58 of segmented mandrel 49.

Linkage member 335 is a cylindrical shaped mandrel which is coupled between upper and lower inflation seals 319, 321, by upper and lower threaded couplings 337, 339 which are sealed to prevent leakage by O-ring seals 341, 343. As fifth segment 58 of segmented mandrel 49 is shifted downward relative to upper and lower inflation seals 319, 321, inflation port 287 may come to rest at a position intermediate upper and lower inflation seals 319, 321. In this position, inflation port 287 is in contact with neither of said inflation chamber 259 and regions exterior of linkage member 335.

Figure 4K:
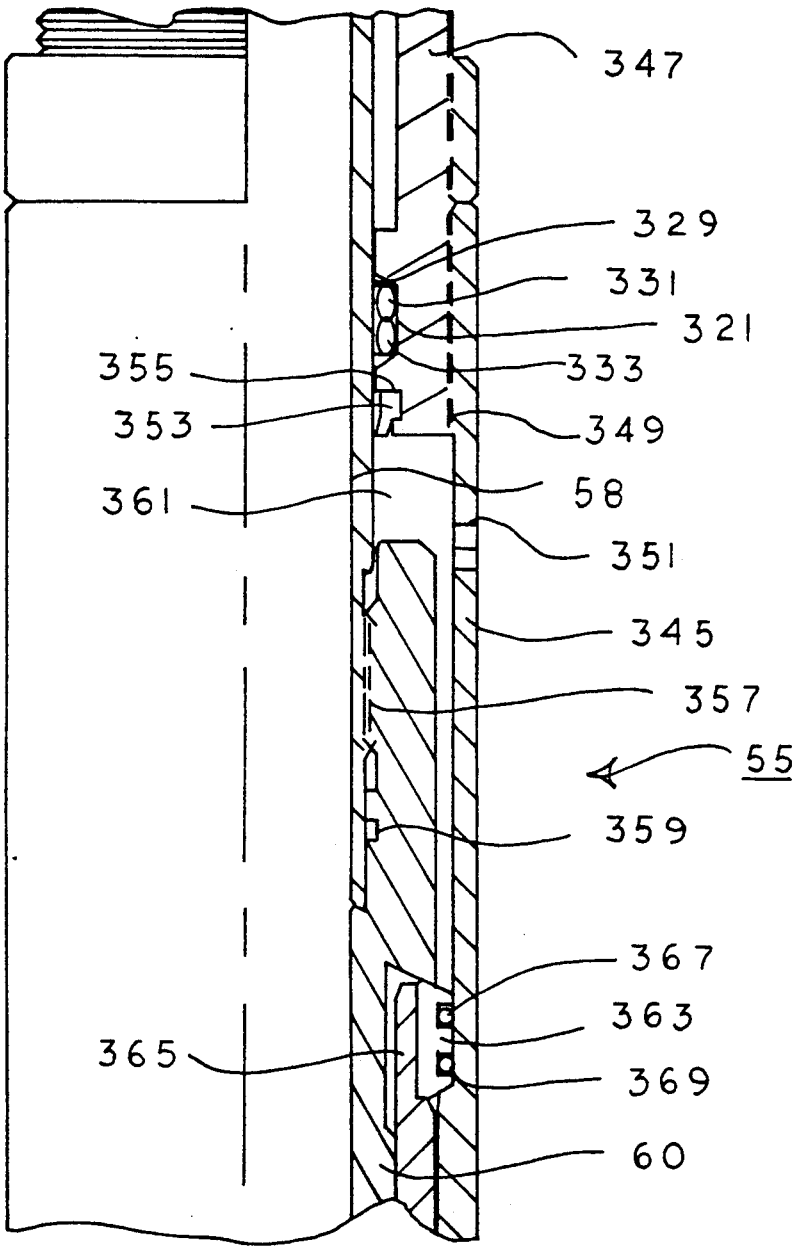
Figure 41:
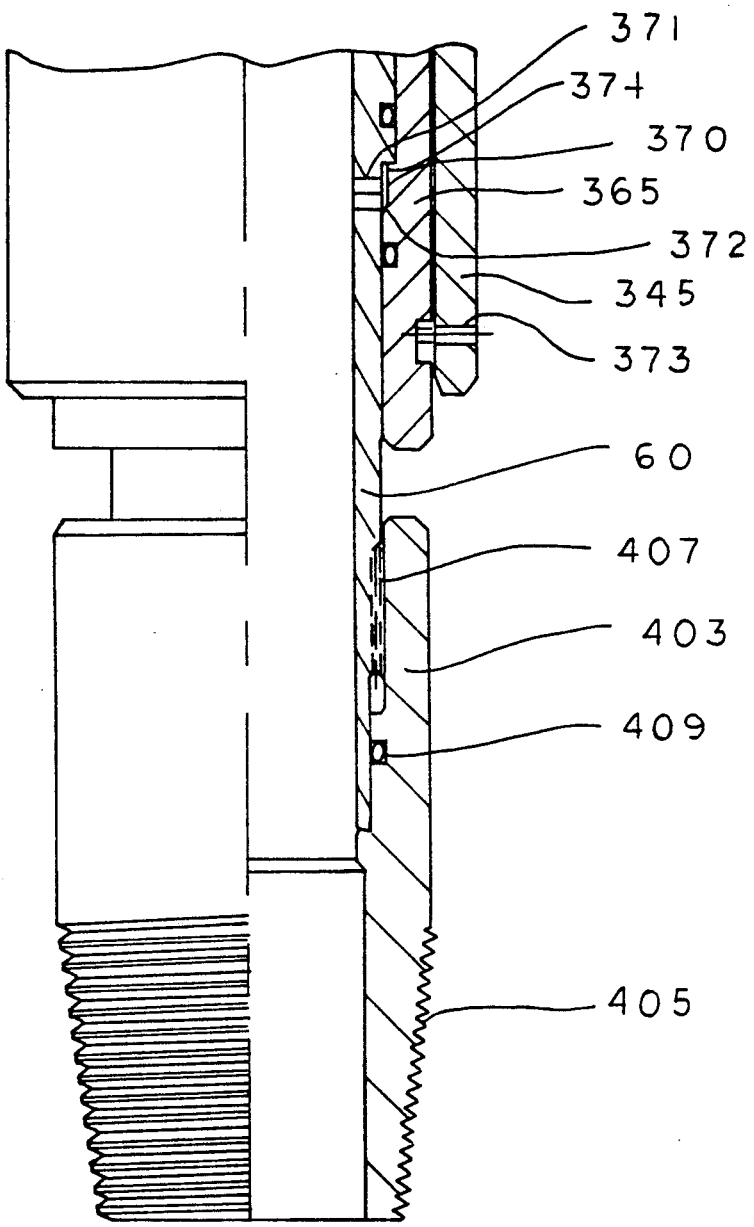

As is best shown in FIG. 4*k*, valve housing 345 is coupled by threaded coupling 349 to seal mandrel 347, and includes vent ports 351. In the open-between mode of operation, inflation port 287 of fifth segment 58 of segmented mandrel 49 is moved into a position downward of lower inflation seal 321 to allow fluid communication between central bore 31 and open-between port 351, which communicates with regions exterior of housing 55 which are between fluid-pressure actuated seal member 21 (above) and fluid-pressure actuated seal member 23 (below). As is shown in FIG. 4*k*, seal mandrel 347 includes wiper ring 353 which is disposed in wiper ring cavity 355 downward of lower inflation seal 321, to prevent debris from passing between fifth segment 58 of segmented mandrel 49 and the lower end of seal mandrel 347.

Sixth segment 60 of segmented mandrel 49 is coupled by threaded coupling 357 to the lowermost end of fifth segment 58 of segmented mandrel 49. O-ring seal 359 is disposed at the interface of fifth segment 58 and sixth segment 60 to prevent the leakage of fluid through threaded coupling 357. Open-between cavity 361 is defined between valve housing 345, fifth segment 58, and sixth segment 60. As is shown in FIG. 4*k*, locking lug 363 serves to couple valve housing 345, sixth segment 60 of segmented mandrel 49, and lug mandrel 365. As is shown in FIG. 4*l*, valve housing 345 is coupled to lug mandrel 365 by shear screw 373. A fluid port 371 is provided through sixth segment 60 of segmented mandrel 49, allowing fluid to pass into cavity 370 which is bounded at its lower end by portion 372 of lug mandrel 365 and at its upper end by portion 374 of sixth segment 60 of segmented mandrel 49. Portion 372 defines a surface area which is larger than the surface area of portion 374. When pressurized fluid passed into the cavity, a greater force is applied to portion 372 than is applied to portion 374, until a sufficient force is obtained to shear screw 373, and stroke lug mandrel 365 downward relative to sixth segment 60 of segmented mandrel 49. The operation of locking lug 363 can best be understood with reference to FIGS. 8*a* and 8*b* which depict locking lug 363 in two operating conditions.

Figure 8A:
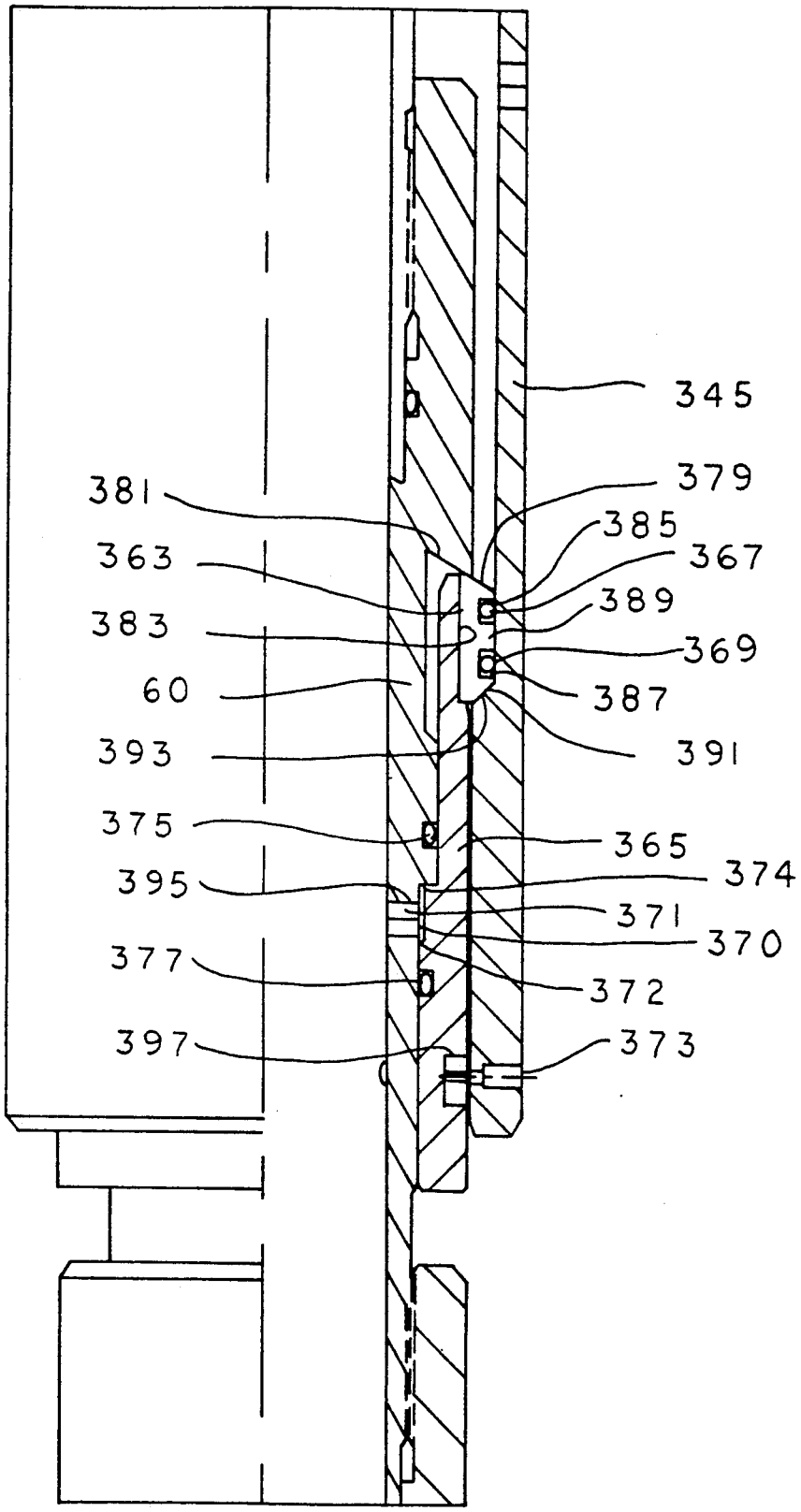
FIGS. 8*a* through 8*b* are detail views of the anti-wadding mechanism of the preferred embodiment of the zone isolation apparatus of the present invention, in a coupled condition and an uncoupled condition, respectively.

In the view of FIG. 8*a*, locking lug 363 is shown in a condition which prevents relative axial movement between valve housing 345 and sixth segment 60 of segmented mandrel 49, but which allows relative rotational movement between valve housing 345 (which is part of housing 55) and sixth segment 60 of segmented mandrel 49. As is shown in FIG. 8*a*, tapered upper edge 379 of locking lug 363 engages at least a portion of internal tapered shoulder 381 of sixth segment 60 of segmented mandrel 49. These serve to engage one another, to prevent relative axial movement, but allow relative rotation. Locking lug 363 is provided with circumferential spring cavities 385, 387, which are adapted to receive springs 367, 369, respectively. Springs 367, 369 bias locking lug 363 radially inward. In the preferred embodiment of the present invention, locking lug 363 comprises a plurality of segments which circumferentially surround sixth segment 60 of segmented mandrel 49, and engage radially-reduced portion 383 of sixth segment 60 of segmented mandrel 49 on the interior surface, and engage radially-reduced portion 389 on the interior surface of valve housing 345. Tapered lower edge 391 engages tapered external shoulder 393 on the interior surface of valve housing 345.

As is shown in FIG. 8*a*, fluid port 371 allows fluid to flow into cavity 370. Shear screw 373 secures valve housing 345 to lug mandrel 365. O-ring seals 375, 377 are provided above and below fluid port 371 to prevent fluid from leaking past cavity 370. Inflation of fluid-pressure actuated seal member 21 causes high pressure fluid to be applied to cavity 370. The difference in area between portion 372 and portion 374 results in a net downward axial radial force being applied to lug mandrel 365, until sufficient force is applied to shear screw 373 to cause it to shear. Once shear screw 373 is sheared, lug mandrel 365 is stroked downward relative to sixth segment 60 of segmented mandrel 49, as is shown in FIG. 8*b*.

Shear screw 373 is disposed in circumferential groove 397 which allows relative rotation between valve housing 345 and lug mandrel 365. Shear screw 373 does prevent axial movement of valve housing 345 relative to lug mandrel 365, and thus prevents the elastomeric components of fluid-pressure actuated seal member 21 from deforming in response to fluid-pressures and fluid flows encountered while running fluid-pressure actuated seal member 21 into subterranean wellbore 25. Shear screw 373 is selected to have a shear threshold valve which is above the fluid pressure amplitude threshold which is associated with inflation control mechanism 285, but which is also less than the force which is exerted by a fully-inflated fluid-pressure actuated seal of the type employed in the preferred zone isolation apparatus of the present invention. Setting the shear value for shear screw 373 ensures that housing mandrel 345 is free to travel axially upward relative to sixth segment 60 of segmented mandrel 49 as fluid-actuated seal member 21 expands radially outward to engage a selected wellbore surface, while preventing distortion or "wadding" of the elastomeric components of fluid-pressure actuated seal member 21 during a running in the hole mode of operation. It is known by those in the industry that elastomeric seal elements will distort as a result of a "swabbing" effect which is encountered in fluid-filled wellbores. In summary, shear screw 373 impedes axial movement up to a preselected force threshold, but does not impede rotational movement. Once the preselected force threshold is obtained, shear screw 373 shears and allows upward movement of valve housing 345 to accommodate the outward radial expansion of fluid-pressure actuated seal member 21.

Figure 8B:
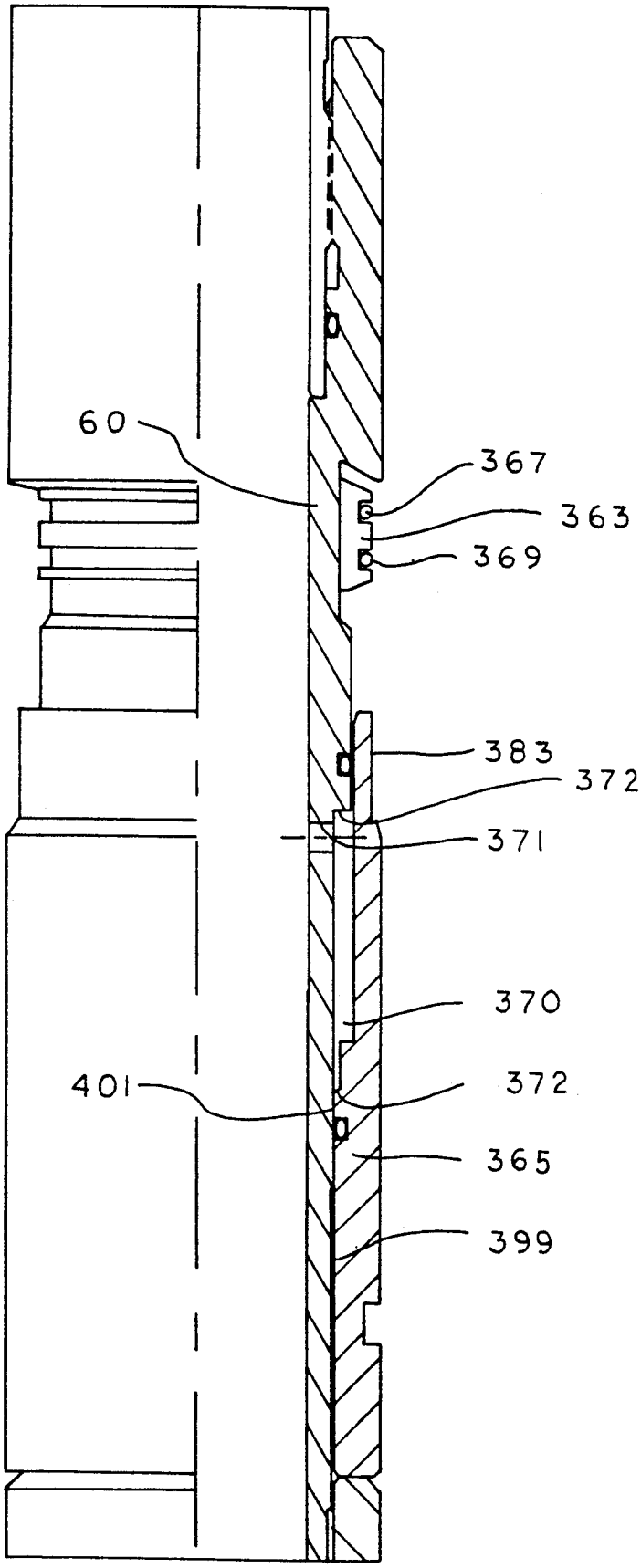

FIG. 8*b* is a view of the lower portion of upper isolator member 15 with valve housing 345 moved axially upward and away from sixth segment 60 of segmented mandrel 49. As is shown in FIG. 8*b*, lug mandrel 365 has been stroked downward relative to sixth segment 60 of segmented mandrel 49, shear screw 373 has been sheared, and housing mandrel 345 has been moved upward. Lug mandrel 365 includes a radially-reduced region 399 on its interior surface, which cannot pass beyond radially enlarged region 401 on the exterior surface of sixth segment 60 of segmented mandrel 49. As a result of the downward movement of lug mandrel 365, locking lug 363 is urged radially inward by springs 367, 369 and into contact with sixth segment 60 of segmented mandrel 49.

Returning now to FIG. 4*l*, pin collar 403 is provided at the lowermost end of sixth segment 60 of segmented mandrel 49, and includes external threads 405. Pin collar 403 is coupled to sixth segment 60 by threaded coupling 407. O-ring seal 409 prevents the passage of fluid through threaded coupling 407.

FIGS. 5*a* through 5*f* provide a one-quarter longitudinal section view of the preferred lower isolator member 17 of zone isolation apparatus 13 of the present invention. Lower isolator member 17 is similar in most respects to upper isolator member 15, so its description will emphasize differences between upper isolator members 15 and lower isolator member 17.

Figure 5A:
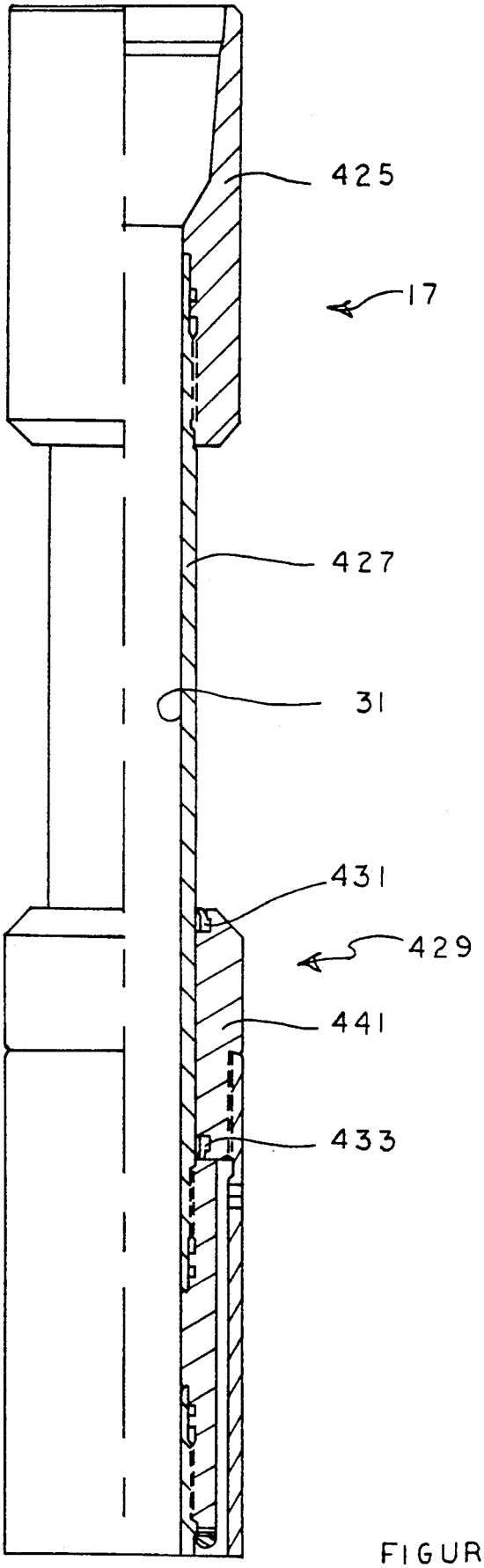
FIGS. 5*a* through 5*f* are one-quarter longitudinal section views of the preferred embodiment of a lower isolator member of the preferred embodiment of the zone isolation apparatus of the present invention.
Figure 5B:
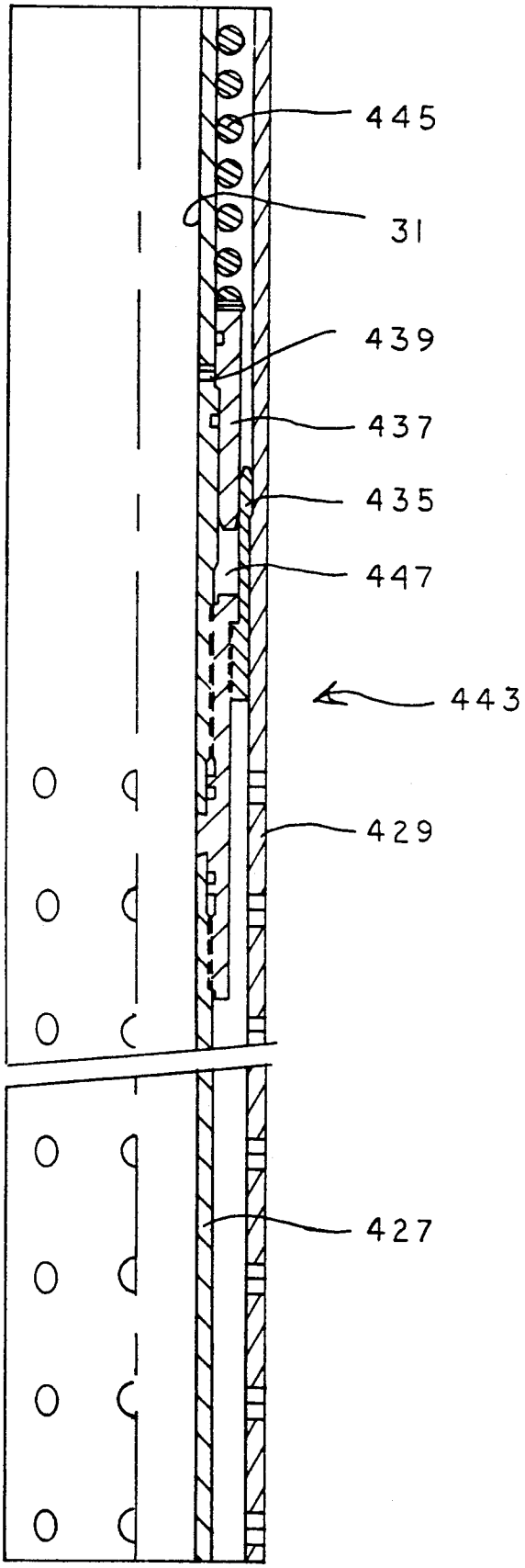

With reference first to FIG. 5*a*, box collar 425 is secured to the uppermost end of segmented mandrel 427 of lower isolator member 17. Segmented mandrel 427 defines central bore 31 which communicates through workstring 29 with upper isolator member 15. Housing 429 is disposed circumferentially about segmented mandrel 427, and rotates freely with respect to segmented mandrel 427 in both a running mode of operation and a setting mode of operation. Wipers 431, 433 are provided in wiper collar 441, and allow relative rotation between segmented mandrel 427 and housing 429, while preventing debris from entering at this interface. As is shown in FIG. 5*b*, lower isolator member 17 includes latch member 443 which is identical to that of upper isolator member 15, and which includes collet member 435, buttress member 437, and port 439 which extends through segmented mandrel 427. Spring 445 biases buttress member 437 downward into flexure cavity 447 to prevent inward radial flexure of collet 435 in response to axial forces applied thereto. High pressure fluid acts upon buttress member 437, urging it axially upward to work against spring 445. When buttress member 437 is removed from flexure cavity 447, collet member 435 may flex radially inward to allow axial loads applied to segmented mandrel 427 to urge segmented mandrel 427 downward relative to housing 429. As is shown in FIG. 5*b*, no track-and-lug assembly is provided for establishing the predetermined operating modes which correspond to the relative axial positions of segmented mandrel 427 and housing 429. The cylindrical track member 171 and lug member 173 of upper isolator member 15 provide the only needed guidance for switching the preferred embodiment of the zone isolation apparatus 13 of the present invention between preselected modes of operation.

Figure 5C:
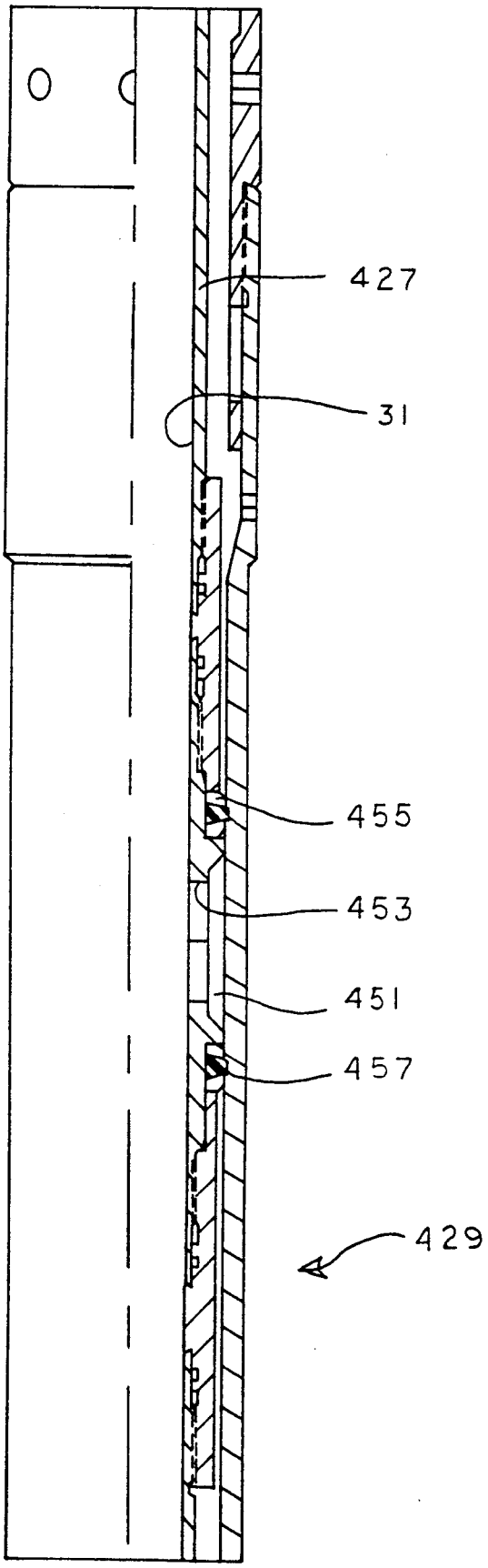

With reference now to FIG. 5*c*, valve 451 is provided for allowing selective communication between central bore 31 and regions exterior of housing floor 29 which are between upper fluid-pressure actuated seal member 21 and lower fluid-pressure actuated seal member 23. Valve 451 is similar in most respects to open-above valve 195 of FIG. 4*e*, with one exception. Valve 451 is adapted for selective alignment with either equalizing port 459 or open-between port 461, since this portion of the zone isolation apparatus 13 is between the upper and lower fluid-pressure actuated seal members 21, 23. Valve 451 includes port 453 which extends through segmented mandrel 427. Dynamic seals 455, 457 are disposed above and below port 453. Dynamic seals 455, 457 dynamically and sealingly engage the interior surface of housing 429. When valve 451 is shifted downward relative to housing 429, it may align with either equalizing port 459 or open-between port 461, or with neither of these ports. In the open-between mode of operation, valve 451 is disposed adjacent open-between port. During the equalizing mode of operation, valve 451 is disposed adjacent equalizing port 459.

Figure 5D:
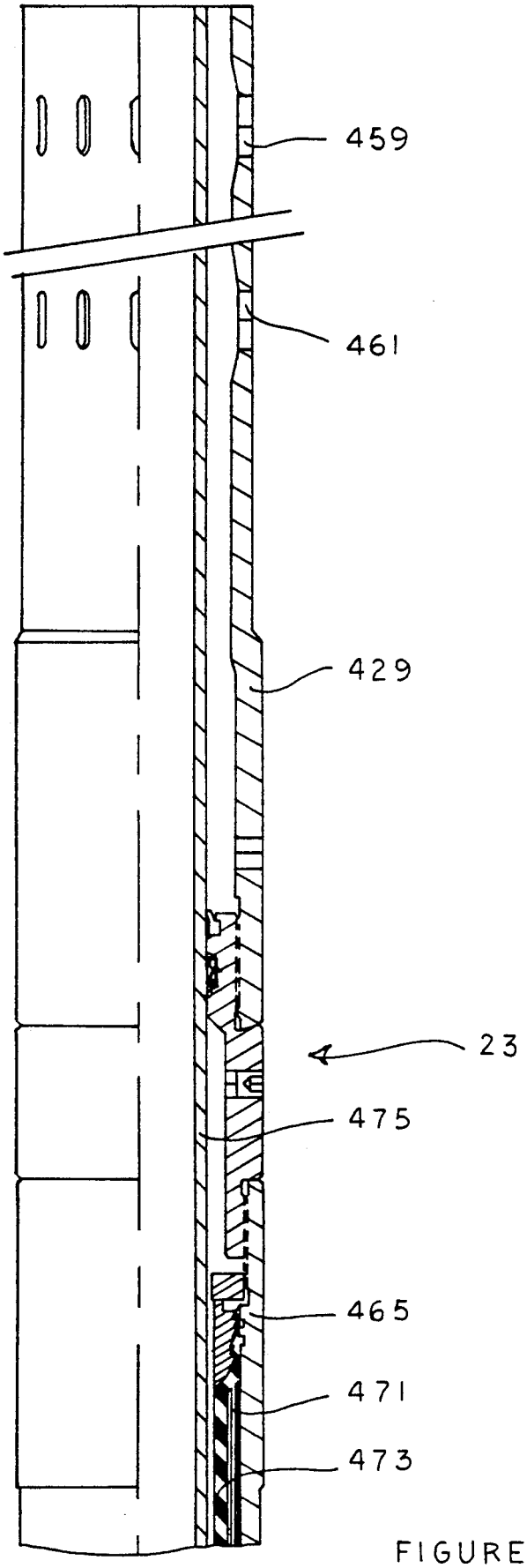

As is shown in FIG. 5*d*, lower isolator member 17 includes fluid-pressure actuated seal member 23 similar to that of upper isolator member 15. Fluid-pressure actuated seal member 23 includes upper collar 465, and lower collar 467 with outer cylindrical elastomeric layer 469, overlapping reinforcement slats 471, and inner cylindrical elastomeric layer 473 disposed therebetween over inflation cavity 475.

Figure 5E:
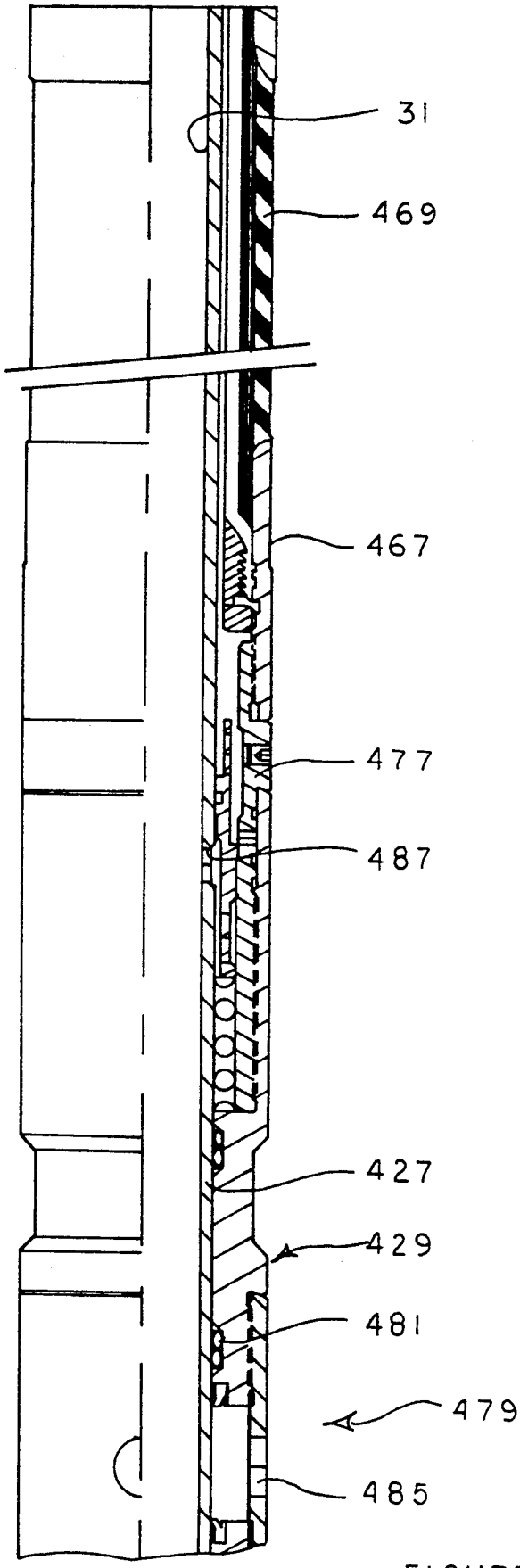

As is shown in FIG. 5*e*, lower isolator member 17 includes inflation control mechanism 477 which prevents fluid from passing into inflation cavity 475 until a preselected fluid pressure amplitude threshold is exceeded by fluid carried in central bore 31.

As is also shown in FIG. 5*e*, open-below valve 479 is provided in housing 429, and includes upper dynamic seal 481 and lower dynamic seal 483 which dynamically and sealingly engage the exterior surface of segmented mandrel 427. Port 485 is carried between upper and lower dynamic seals 481, 483. To obtain an open-below mode of operation, segmented mandrel 427 is moved axially downward relative to housing 429, causing inflation port 487 to align with port 485 of housing 429 to allow fluid communication between central bore 31 and regions of the wellbore which are exterior of housing 429 and below lower isolator member 17.

Figure 5F:
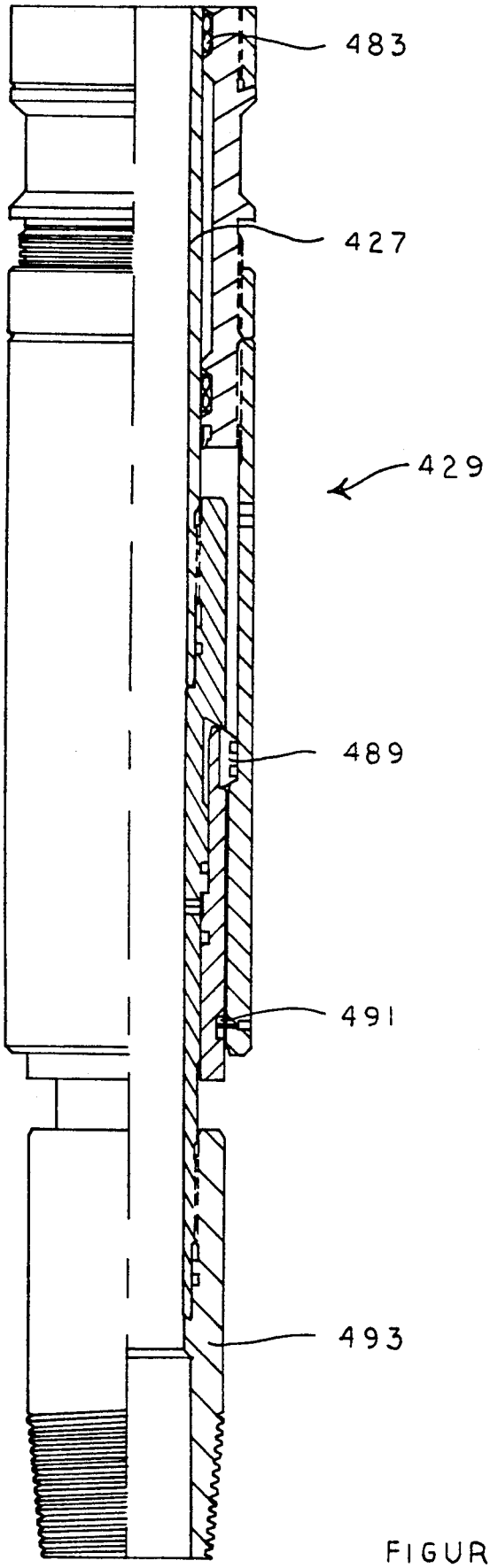

As is shown in FIG. 5*f*, lower isolator member 17 includes locking lug 489, like that found in upper isolator member 15, which allows relative rotation between segmented mandrel 427 and housing 429. Lower isolator member 17 further includes shear screw 491 which prevents swabbing of the elastomeric elements carried by lower isolator member 17 during a running of the tool into the wellbore, but which allows relative rotation of segmented mandrel 427 and housing 429. At its lowermost end, lower isolator member 17 includes box collar 493 to allow lower isolator member 17 to be coupled into a selected location within workstring 29.

While the invention has been shown in only one of its forms, it is not thus limited but is susceptible to various changes and modifications without departing from the spirit thereof.

What is claimed is:

1. A zone isolation apparatus for use in a subterranean wellbore, comprising:

a workstring:

a plurality of fluid-pressure actuated seal members carried about said workstring at selected locations;

a rotary coupling between said plurality of fluid-pressure actuated seal members and said workstring, which allows relative rotation between said plurality of fluid-pressure actuated seal elements and said workstring during:

(a) a running mode of operation with said plurality of fluid-pressure actuated seal elements in radially reduced positions; and (b) a sealing mode of operation with said plurality of fluid pressure actuated seal elements in radially enlarged positions and in sealing engagement with a selected wellbore surface.

2. A zone isolation apparatus according to claim 1, further including:

means for coupling any selected number of wellbore tubular conduit members into said workstring between selected ones of said fluid-pressure actuated seal members to allow a range of possible spacing between said fluid-pressure actuated seal members.

3. A zone isolation apparatus according to claim 2, wherein said means for coupling allows selection of a particular spacing between selected fluid-pressure actuated seal members and coupling of wellbore tubular conduit members on location at said subterranean wellbore.

4. A zone isolation apparatus according to claim 2, wherein said means for coupling allows coupling of wellbore tubular conduit members with application of torque only.

5. A zone isolation apparatus according to claim 1, wherein each of said plurality of fluid-pressure actuated seal members includes:

an inflation port which, while in an open condition, allows fluids to communicate between a central bore of said workstring and an inflation chamber of said fluid-pressure actuated seal member, which is switched between an open condition and a closed condition by axial movement of said workstring.

6. A zone isolation apparatus according to claim 1, which further includes for a selected pair of fluid-pressure actuated seal members:

(a) a first fluid communication port which, while in an open condition, allows fluids to communicate between said workstring and a region of said subterranean wellbore above said selected pair of fluid-pressure actuated seal members, and which, while in a closed condition, prevents communication between said workstring and said region of said subterranean wellbore above said selected pair of fluid-pressure actuated seal members;

(b) a second fluid communication port which, while in an open condition, allows fluids to communicate between said workstring and a region between said selected pair of fluid-pressure actuated seal members, and which, while in a closed condition, prevents communication between said workstring and said subterranean wellbore between said selected pair of fluid-pressure actuated seal members; and (c) a third fluid communication port which, while in an open condition, allows fluids to communicate between said workstring and a region below said selected pair of fluid-pressure actuated seal members, and which, while in a closed condition, prevents communication between said workstring and said region of said subterranean wellbore below said selected pair of fluid-pressure actuated seal members.

7. A zone isolation apparatus according to claim 6, wherein said first fluid communication port, said second fluid communication port, and said third fluid communication port are switched between open and closed conditions by axial movement of said workstring.

8. A zone isolation apparatus according to claim 6, wherein axial movement of said workstring in a predetermined pattern switches said zone isolation apparatus between selected ones of a plurality of modes of operation: including (a) an open-above mode of operation, with said first fluid communication port in an open condition and with said second and third fluid communication ports in closed conditions;

(b) an open-between mode of operation, with said second fluid communication port in an open condition and with said first and third fluid communication ports in closed conditions; and (c) an open-below mode of operation, with said third fluid communication port in an open condition and with said first and second fluid communication ports in closed conditions.

9. A zone isolation apparatus according to claim 6, wherein, during an equalizing mode of operation, said first fluid communication port, said second fluid communication port, and said third fluid communication port are all maintained in open conditions to allow equalization of pressure between said workstring, said region of said subterranean wellbore above said selected pair of fluid-pressure actuated seal members, said region of said subterranean wellbore between said selected pair of fluid-pressure actuated seal members, and said region of said subterranean wellbore below said selected pair of fluid-pressure actuated seal members.

10. A zone isolation apparatus according to claim 6, wherein, during a test mode of operation, said first fluid communication port, said second fluid communication port, and said third fluid communication port are all maintained in closed conditions to allow pressure testing of said workstring.

11. A zone isolation apparatus for use in a subterranean wellbore having a target zone therein with which selective fluid communication is desired, comprising:

a wellbore tubular conduit having a central bore for communicating fluids between selected regions of said wellbore;

a plurality of isolator members, including at least:

(a) an upper isolator member for engaging said subterranean wellbore and selectively and substantially occluding an annular region between said wellbore tubular conduit and said subterranean wellbore above said target zone;

(b) a lower isolator member for engaging said subterranean wellbore and selectively and substantially occluding an annular region between said wellbore tubular conduit and said subterranean wellbore below said target zone;

said upper and lower isolator members together defining selectively actuable fluid communication ports including:

(a) a first fluid communication port which, while in an open condition, allows fluids to communicate between said central bore of said wellbore tubular conduit and a region of said subterranean wellbore above said upper isolator member, and which, while in a closed condition, prevents communication between said central bore of said wellbore tubular conduit and a region of said subterranean wellbore above said isolator member;

(b) a second fluid communication port which, while in an open condition, allows fluids to communicate between said central bore of said wellbore tubular conduit and said target zone, and which, while in a closed condition, prevents communication between said central bore of said wellbore tubular conduit and said target zone; and (c) a third fluid communication port which, while in an open condition, allows fluids to communicate between said central bore of said wellbore tubular conduit and a region of said subterranean wellbore below said lower isolator member, and which, while in a closed condition, prevents communication between said central bore of said wellbore tubular conduit and said target zone.

12. A zone isolation apparatus according to claim 11, wherein said selectively actuable fluid communication ports are switched between open and closed conditions by axial movement of said wellbore tubular conduit relative to said upper and lower isolator members.

13. A zone isolation apparatus according to claim 11, wherein axial movement of said wellbore tubular conduit in a predetermined pattern switches said zone isolation apparatus between selected ones of a plurality of modes of operation, including:

(a) an open-above mode of operation, with said first fluid communication port in an open condition and with said second and third fluid communication ports in closed conditions;

(b) an open-between mode of operation, with said second fluid communication port in an open condition and with said second and third fluid communication ports in closed conditions; and (c) an open-below mode of operation, with said third fluid communication port in an open condition and with said first and second fluid communication ports in closed positions.

14. A zone isolation apparatus according to claim 11, wherein, during an equalizing mode of operation, said first fluid communication port, said second fluid communication port, and said third fluid communication port are all maintained in open conditions to allow equalization of pressure between said wellbore tubular conduit, a subterranean wellbore region above said upper isolator member, a subterranean wellbore region between said upper isolation member and said lower isolator member, and a subterranean wellbore region below said lower isolator member.

15. A zone isolation apparatus according to claim 11, wherein, during a test mode of operation, said first fluid communication port, said second fluid communication port, and said third fluid communication port are all maintained in closed conditions to allow pressure testing of said wellbore tubular conduit.

16. A zone isolation apparatus according to claim 11, further including:

(a) a rotary coupling between said upper isolator member and said wellbore tubular conduit, for allowing relative rotation between said upper isolator member and said wellbore tubular conduit; and (b) a rotary coupling between said lower isolator member and said wellbore tubular conduit, for allowing relative rotation between said lower isolator member and said wellbore tubular conduit.

17. A zone isolation apparatus according to claim 11, further including:

means for coupling any selected number of wellbore tubular conduit members into said workstring between said upper isolator member and said lower isolator member and said lower isolator member to allow a range of possible spacings between said upper isolator member and said lower isolator member.

18. A zone isolation apparatus according to claim 17, wherein said means for coupling allows coupling of wellbore tubular conduit members on location at said subterranean wellbore.

19. A zone isolation apparatus according to claim 11, wherein said upper and lower isolator members comprise:

a flexible seal member in contact with an inflation chamber;

an inflation port which, while in an open condition, allows fluid communication between said central bore of said wellbore tubular conduit and said inflation chamber, and which, while in a closed condition, prevents communication between said central bore of said wellbore tubular conduit and said inflation chamber;

wherein said inflation port is switched between said open condition and said closed condition by axial movement of said wellbore tubular conduit; and wherein said flexible seal member is urged outward into sealing engagement with a selected wellbore surface by application of pressurized fluid from said central bore of said wellbore tubular conduit to said inflation chamber.

20. A zone isolation apparatus according to claim 19, wherein said flexible seal member is urged out of sealing engagement with said selected wellbore surface by venting of pressurized fluid from said inflation chamber to said central bore of said wellbore tubular conduit.

21. A zone isolation apparatus according to claim 19, further including:

a latch member for preventing axial movement of said wellbore tubular conduit relative to said plurality of isolator members, until a predetermined fluid-pressure threshold, sufficient to outwardly expand said flexible seal member into sealing engagement with a selected wellbore surface, is exceeded by fluid carried in said central bore of said wellbore tubular conduit.

22. A zone isolation apparatus according to claim 21, wherein said latch member also maintains said inflation port in said open condition until said predetermined fluid-pressure threshold is exceeded.

23. A zone isolation apparatus for use in a subterranean wellbore having at least one target zone therein with which selective fluid communication is desired, comprising:

a workstring composed of a plurality of wellbore tubular conduit members coupled together;

a plurality of fluid-pressure actuated seal members, each including:

(a) a mandrel with a central bore in fluid communication with said workstring;

(b) means for coupling said mandrel in a selected location within said workstring, without regard to the location of others of said plurality of fluid pressure actuated seal members;

(c) a housing carried exteriorly of said mandrel;

(d) a flexible seal member carried by said housing and in communication with an inflation chamber; and (e) said mandrel having a plurality of fluid communication ports defined therethrough for selective communication with portions of said housing, including an inflation-deflation port which allows selective communication between said workstring and said inflation chamber when said housing is in a predetermined axial position relative to said mandrel.

24. A zone isolation apparatus for according to claim 23, further comprising:

a latch member for maintaining said axial position between said housing and said mandrel until fluid having a pressure exceeding a predetermined inflation force threshold is applied to said inflation chamber.

25. A zone isolation apparatus according to claim 24, wherein said latch member uncouples said housing from said mandrel upon application of said fluid having a pressure exceeding said predetermined inflation force threshold, to allow relative axial movement between said mandrel and said housing over a selected axial displacement range, with preselected relative axial positions corresponding to a plurality of modes of operation.

26. A zone isolation apparatus according to claim 25, wherein said plurality of modes of operation include at least one of:

(a) an open-above mode of operation with said central bore of said mandrel in fluid communication with a region of said subterranean wellbore which is above a selected one of said at least one target zone;

(b) an open-below mode of operation with said central bore of said mandrel in fluid communication with a region of said subterranean wellbore which is below a selected one of said at least one target zone;

(c) an open-between mode of operation with said central bore of said mandrel in fluid communication with a region of said subterranean wellbore which is adjacent at least a portion of said at least one target zone; and (d) an equalizing mode of operation with said central bore of said mandrel simultaneously in fluid communication with regions of said subterranean wellbore which are above, below, and adjacent said target zone.

27. A zone isolation apparatus according to claim 24, wherein said latch member includes:

a collet member for releasably engaging a mating member to hold said housing and said mandrel together in a fixed relative axial position;

a buttress member for selectively engaging a portion of said collet member to prevent flexure thereof; and a release mechanism for maintaining said buttress member in engagement with said collet member until fluid in said workstring exceeds a preselected fluid-pressure threshold.

28. A zone isolation apparatus according to claim 27, wherein:

said collet member is mechanically coupled to said mandrel; and said mating member is mechanically coupled to said housing.

29. A zone isolation apparatus according to claim 27, wherein:

said buttress member comprises a sleeve which is biased to wedge said collet member into engagement with said mating member.

30. A zone isolation apparatus according to claim 29, wherein said release mechanism includes:

a fluid-pressure sample port in fluid communication with said workstring; and a piston member which receives fluid from said fluid-pressure sample port and which works against said bias of said buttress member to allow disengagement of said buttress member from said collet member, thus allowing flexure of said collet member away from said mating member, and thereby allowing relative axial displacement of said mandrel and said housing.

31. A zone isolation apparatus according to claim 23, further including:

a rotary coupling between said housing and said mandrel, to allow relative rotation between said housing and said mandrel.

32. A zone isolation apparatus according to claim 23, further including:

a track defined between said mandrel and said housing defining a predetermined allowable axial movement pattern for relative axial motion of said mandrel and said housing; and at least one lug for traversing said track.

33. A zone isolation apparatus according to claim 26, further including:

a track defined between said mandrel and said housing a predetermined allowable axial movement pattern for relative axial motion of said mandrel and said housing;

at least one lug for traversing said track; and wherein said predetermined allowable axial movement pattern defines at least one station which corresponds to at least one of said plurality of modes of operation.

34. A zone isolation apparatus according to claim 23, wherein said means for coupling allows coupling of any selected member of wellbore tubular conduit members into said workstring between selected ones of said plurality of fluid-pressure actuated seal members.

35. A zone isolation apparatus according to claim 23, wherein said means for coupling allows coupling of any selected member of wellbore tubular conduit members into said workstring between selected ones of said plurality of fluid-pressure actuated seal members, on location at said subterranean wellbore.

36. A zone isolation apparatus according to claim 23, further including:

an anti-wadding member to prevent axial displacement of said flexible seal member during a running in the hole mode of operation.

* * * * *